US010532487B2

(12) United States Patent
Ernst

(10) Patent No.: US 10,532,487 B2
(45) Date of Patent: Jan. 14, 2020

(54) METHOD FOR WORKING SURFACES OF WOOD-BASED MATERIALS

(71) Applicant: Jowat SE, Detmold (DE)

(72) Inventor: Rüdiger Ernst, Detmold (DE)

(73) Assignee: Jowat SE, Detmold (DE)

( * ) Notice: Subject to any disclaimer, the term of this patent is extended or adjusted under 35 U.S.C. 154(b) by 0 days.

(21) Appl. No.: 15/692,344

(22) Filed: Aug. 31, 2017

(65) Prior Publication Data

US 2018/0065273 A1 Mar. 8, 2018

(30) Foreign Application Priority Data

Sep. 2, 2016 (EP) ..... 16187043

(51) Int. Cl.

| | |
|---|---|
| ***B27N 7/00*** | (2006.01) |
| ***B05D 1/40*** | (2006.01) |
| ***B05D 3/00*** | (2006.01) |

(52) U.S. Cl.

CPC ..... *B27N 7/005* (2013.01); *B05D 1/40* (2013.01); *B05D 3/007* (2013.01); *B05D 2203/20* (2013.01)

(58) Field of Classification Search

None

See application file for complete search history.

(56) References Cited

U.S. PATENT DOCUMENTS 5,316,812 A * 5/1994 Stout ..... B24D 11/00 428/143
5,741,391 A 4/1998 Ollila
5,753,747 A * 5/1998 Oien ..... C08G 18/12 524/590
6,144,425 A * 11/2000 Kawabata ..... G02F 1/13336 349/122
2002/0108706 A1* 8/2002 Roth ..... G09F 3/0288 156/252
2002/0155223 A1 10/2002 Colvin et al.
2004/0028482 A1* 2/2004 Becker ..... C08G 69/34 405/263
2014/0342135 A1* 11/2014 Lorenz ..... B27N 7/00 428/201
2015/0197942 A1 7/2015 Pervan et al.

FOREIGN PATENT DOCUMENTS

| | | | |
|---|---|---|---|
| DE | 19630270 | A1 | 1/1998 |
| DE | 10226422 | C1 | 11/2003 |
| EP | 0373726 | A2 | 6/1990 |
| JP | H0711333 | U | 2/1995 |
| JP | 2002086617 | A | 3/2002 |
| JP | 2004276463 | A | 10/2004 |
| WO | 0162492 | A1 | 8/2001 |

OTHER PUBLICATIONS

Gluemachinery, "Plywood Repair—Hole Filling with Hot Melt Glue Guns", Youtube, (Oct. 22, 2011), <https://www.youtube.com/watch?y=ROHEIemaxIY>.*

Gluemachinery, Video Description for "Plywood Repair—Hole Filling with Hot Melt Glue Guns", Youtube, (Oct. 22, 2011).*

* cited by examiner

*Primary Examiner* — Kelly M Gambetta

(74) *Attorney, Agent, or Firm* — Edward E. Sowers; Brannon Sowers & Cracraft PC

(57) ABSTRACT

The invention relates to a method for treating, especially levelling, at least one surface, preferably at least one flat side surface, of oriented strand boards (i.e. OSB wood composite boards) and also to the products obtainable in this way as well as to the uses thereof.

15 Claims, 3 Drawing Sheets

METHOD FOR WORKING SURFACES OF WOOD-BASED MATERIALS

CROSS-REFERENCES TO RELATED APPLICATIONS

This application claims priority under 35 U.S.C. § 119 to European Patent Application EP 16 187 043.1, filed Sep. 2, 2016, the disclosure of which is incorporated herein by reference.

BACKGROUND OF THE INVENTION

The present invention relates to the technical field of wood-based materials in the form of oriented strand boards or OSB wood composite boards, and to their working or treatment.

The present invention especially relates to a method for treating, especially levelling, at least one surface, preferably at least one flat side surface, of oriented strand boards or OSB wood composite boards.

The present invention likewise relates to an oriented strand board or OSB wood composite board as such which is obtainable by the method according to the present invention or which has at least one treated, especially leveled, surface, preferably flat side surface.

The present invention further relates to a production plant for treating, especially levelling, at least one surface, preferably at least one flat side surface, of oriented strand boards or for implementing the method according to the present invention.

The present invention additionally relates to the use of at least one hotmelt adhesive for increasing the weathering, UV and/or moisture resistance of an oriented strand board or for furnishing an oriented strand board with applications properties for the exterior sector.

The present invention also further relates to the use of at least one hotmelt adhesive for homogenizing or levelling the surface, preferably flat side surface, of an oriented strand board.

The present invention, furthermore, also relates to the use of at least one oriented strand board of the invention as or for producing paneling, facings, façade elements, façade panels, construction elements or construction boards, especially in the (construction) exterior sector or (construction) interior sector and/or furniture or furniture elements, furniture panels, construction elements or construction boards, especially in furniture, shop and trade fair construction, and/or packaging and transport elements and panels, especially in the transport, logistics and/or packaging sector.

Lastly, the present invention also relates to construction elements or façade elements as such which comprise or consist of at least one oriented strand board according to the invention.

BRIEF SUMMARY OF THE INVENTION

Wood-based material boards are, in general, materials in board form which are produced by comminuting wood and subsequently assembling or compressing the wood-based structural elements or wood particles. The size and shape of the wood particles dictate the nature of the wood-based material and its properties. The wood particles on which the boards are based may be joined to one another using binders and also via mechanical connections (e.g. mutual hook engagement or interengagement of the wood particles during compression). The product portfolio of many manufacturers of wood-based material boards includes board types in the form of chipboard, wood fibreboard, such as MDF boards (medium-density fibreboards), HDF boards (high-density fibreboards), DHF boards ("breathable" wood fibreboards), and also, furthermore, what are called oriented strand boards (OSB wood composite boards or Oriented Structural Boards).

The oriented strand boards or OSB wood composite boards in question, also referred to synonymously as strand boards or OSB boards, are, generally speaking, wood-based materials in board form which are produced using relatively large, elongated chips ("strands"). Oriented strand boards find wide-ranging use especially in the sector of the construction industry, and can be produced, for example, in industrial plants by initially cutting out elongate chips from debarked roundwood in lengthwise direction using rotating knives, in a chip preparation procedure, the natural moisture in such chips being reduced at high temperatures by subsequent drying. This may be followed by resination of the chips, with the pretreated chips being subsequently first oriented lengthwise and crosswise, or scattered, in a throw-down process, for example, for the production of the actual OSB board, thereby creating for example, a crosswise layer construction which increases the structural stability. The oriented strand boards are subsequently generally manufactured at high pressure and at high temperature, in particular on continuous presses. Relative to other wooden board systems, such as MDF boards, oriented strand boards are generally notable for enhanced flexural strength, this being achieved in particular through the use of the relatively large, elongated chips. For the same reasons, in construction applications, oriented strand boards are often employed as construction boards in shell construction, and as wall or roof paneling in interior fitment. In the flooring sector, they serve, for example, as installation boards, in which case, for example, boards with a tongue and groove profile are employed. In principle, moreover, the oriented strand boards in question are also employed as formwork boards for concrete or the like.

In contrast to chipboards and also to HDF or MDF fibreboards, which generally have a relatively smooth or planar surface, oriented strand boards feature irregular structuring or shaping of the surface, and especially of the flat side surface, with occasionally substantial unevenesses, cavities and/or indentations or the like, this being caused in particular by the relatively large and irregularly shaped wood chips of the kind used in the production of oriented strand boards. As a result of the unevennesses, cavities and/or indentations that are present in particular in the region of the flat side surface of the oriented strand boards, the dimensional accuracy of the parent boards is often less than optimum, especially since the surface is difficult to level by means of sanding down or the like, for example, because of the occasionally severe indentations and unevennesses. It should also be borne in mind here that the unevennesses, indentations and/or cavities or the like in question may extend through the entire board.

A particular feature of oriented strand boards or OSB wood composite boards, therefore, is the underlying chip geometry, which is associated on the one hand with corresponding advantages, in respect of a high flexural strength, for example, but also with the fundamental disadvantage that in the ready-to-use product in the form of the OSB board, there is a highly irregular or inconsistent shaping of the surface present, since the coarse-chip structure and the spacing of the chips mean that there are occasionally considerable unevennesses, indentations, cavities or the like present in the parent board, including in the region of its surface.

This is also associated in particular with disadvantageous visual properties of the surface, meaning that occasionally the oriented strand boards in question are not suitable for sustained use in the direct visible area, despite the fact that, fundamentally, on account of their specific chip structure, the OSB boards themselves have a striking visual quality. In particular, the high degree of irregularity of the surface structure also results in increased dirt susceptibility and also in occasionally unsatisfactory properties in respect of weathering resistance and moisture resistance.

Because of the above-described irregular structuring of the surface, oriented strand boards have only limited weathering resistance, especially since moisture is easily able to penetrate the cavities in the board. In this connection, the irregular surface also has disadvantages in respect of further enhancement, such as homogeneous coating or the like.

Also for this reason, OSB boards have to date been unavailable or unsuitable to a sufficient degree for further (surface) enhancement steps. Also for this reason, oriented strand boards have to date been used almost exclusively for those construction applications which lie primarily not in the direct visible area.

In relation to oriented strand boards overall there is a great demand for the range of utility to be expanded and for the underlying product properties, particularly in relation to the surface quality, to be further improved, since this type of board, with a good price/performance relationship, possesses positive board properties overall, particularly in relation to the board stability or the fundamentally striking surface appearance, thus awaking fundamental interest in the use of this type of board—not least in comparison, for example, to chipboard—in other fields of application.

In the prior art, approaches to treating the surface of wood-based material boards in board form as such are generally pursued, such approaches occasionally also being directed at making the surface more uniform.

One such approach pursued, among others, is that whereby, using UV-curing coating systems in a multi-coat application, the surface of a wood-based material board is to be standardized. This method, however, has the disadvantage in particular that the UV-curing coating films can generally only be sufficiently cured in the region of up to 0.3 mm per curing process, so that the working of large indentations or unevennesses in the surface that may be present, and which may have an extent of up to several millimetres, is not possible or necessitates a considerable number of working steps, to the significant detriment of the economics of the method.

As well as the comparatively high purchase price for UV-curing coating systems, moreover, there is a risk that residual monomers will remain if curing is not complete. Furthermore, the energy input needed in the case of a multi-stage curing operation is generally high and therefore uneconomic. The surfaces of wood-based material boards coated or treated by means of UV-curing coating systems, furthermore, have only a very limited spectrum of adhesion, thus necessitating in particular a further coating or enhancement or surface treatment by means for example of adhesion-lining with condensation resin films, in short-cycle presses or the like, for example.

A further approach to the levelling of surfaces in wood-based material boards can be seen, moreover, in the partial filling-in, for example, of knot holes or cracks in individual plies of composite board materials, as in the case of plywood or ready-to-lay wood flooring, for example, and additionally in the case of solid wood; for these purposes, in principle, plastics are used for introduction into the knot holes that are present. The throughput of such a procedure is occasionally only low, in particular, this being a disadvantage especially when the number of indentations or unevennesses is high, and so the parent process often cannot be operated economically.

In this connection, in the area of the enhancement of solid wood or solid-wood boards, methods employed in the prior art include those in which defects are first milled out generously, using a milling device, after which corresponding solid-wood pieces adapted to the milled area are introduced into the indentations formed beforehand, an operation which may be undertaken manually or by machine, for example. Where there are a large number of indentations or unevennesses present in a parent board, such methods cannot be implemented economically.

A further approach is the filling-in of indentations or unevennesses in the surface of wood-based material boards using water-based or solvent-based filler systems. The use of such systems, however, leads to product properties which are not always satisfactory, especially since in the course of processing, water-based filling systems may cause swelling of the chips in the wood-based material boards, owing to the high water content, which is a disadvantage in relation to the surface properties and may in particular lead to considerable visual disturbance in the surface. Moreover, the drying of water-thinnable or water-based filling compounds, especially at deeper sites, is occasionally problematic, since the solvent in the form of water can be difficult to remove. Water-based systems, furthermore, generally lead after re-drying to a contraction in volume of a magnitude matching the volume of the quantity of water present beforehand. It is therefore not possible in one working step to attain a level or uniform surface, thus necessitating costly and inconvenient after treatments for the levelling of the surface.

Furthermore, solvent-based systems, produced using organic solvents, impose exacting requirements on workplace safety, particularly with regard to the prevention of emissions, and the subsequent disposal or recycling of an organic solvent, in the form of use for heat recovery, for example, by incineration or the like, for example, is occasionally not ideal from the economic standpoint.

In this connection, EP 1 749 587 A1, or DE 10 2005 036 579 A1, which belongs to the same patent family, relates to a construction board composed of a wood-based material, said board consisting of at least three plies of scattered and compressed, resinated chips, having an upper outer layer and a lower outer layer, with the upper outer layer at least having a coating which fills out surface unevennesses, said coating consisting of a water-based coating material with adjuvants and/or fillers.

Within the prior art, in particular, there are also approaches to providing wood-based material boards in general with additional homogeneous outer layers, as is the case for chipboard, for example. This, however, requires drastic interventions in the actual process of producing the wood-based material board, since a separate flow of material has to be integrated into the existing process, beginning from chip preparation through drying and through the storage of the outer-layer chips through to the resinating and scattering of the outer-layer chips.

A further approach, moreover, which in terms of its outcome is fundamentally comparable, lies in the application or doubling-up of additional outer plies, which may take the form, for example, of veneers, thin-layer plates or thin fibre plates. Such methods, however, are equally costly and do not always lead to the desired product quality.

All in all, therefore, the approaches known in the prior art to the treatment or levelling of the surfaces of wood-based material boards do not always lead to the desired product properties, and, furthermore, the approaches in the prior art are often not always ideal from the standpoint of costs either. Furthermore, the approaches and methods in the prior art often cannot be used for specific wood-based material boards in the form of oriented strand boards or OSB wood composite boards, since OSB wood composite boards possess highly specific physical properties, particularly in respect of the presence of sometimes large or high-volume unevennesses, indentations, cavities, holes and/or craters in the board surface.

Against this technical background, therefore, one object of the present invention is to provide a method and a corresponding production plant for treating, especially levelling, a surface, especially a flat side surface, of oriented strand boards or OSB wood composite boards, where the disadvantages and inadequacies of the prior art, depicted above, are to be at least largely avoided or else at least attenuated. By virtue of the present invention, corresponding oriented strand boards are to be provided, in a technically efficient way, which have an optimally leveled or filled-in surface. The aim with the present invention in particular is for corresponding indentations or unevennesses and also cavities, holes and/or craters or the like in the region of the surface or flat side surface of oriented strand boards to be efficiently compensated or filled in sustainably and effectively.

In particular, an object of the present invention is to provide a method, and a production plant suitable for implementing this method, with which it is to be possible to treat the surfaces especially of oriented strand boards, with the consequence that on this basis as well the product properties of the oriented strand boards thus treated, not least in relation to the provision of weathering, UV and temperature resistance, are further improved, in tandem with an increase in the spectrum of use of the oriented strand boards thus treated.

In this connection, yet a further object of the present invention is that of providing oriented strand boards as such which exhibit resistant and durable and also uniform filling-in and/or coating of the unevennesses, indentations, cavities, holes and/or craters that are present in the region of the surface; the oriented strand boards provided in accordance with the invention are also to have further improved product properties, especially improved (surface) properties, relative to those wood-based material boards of the prior art.

DETAILED DESCRIPTION OF THE INVENTION

Figure 1:
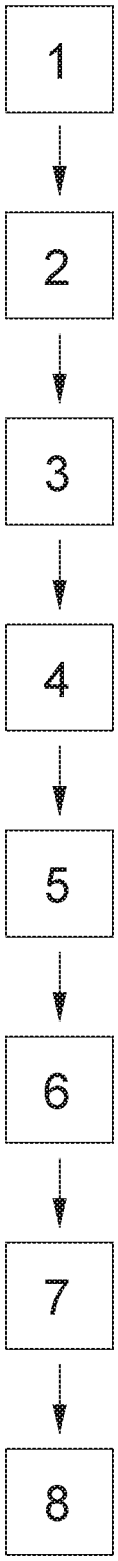
FIG. 1 shows a diagrammatic representation in the form of a flow diagram of a procedure according to the invention, in accordance with one inventive embodiment, for the treatment, especially levelling, of at least one surface, preferably at least one flat side surface, of oriented strand boards.

The object on which the present invention is based is achieved—according to a first aspect of the present invention—by a method for treating, especially levelling, at least one surface, preferably at least one flat side surface, of oriented strand boards (OSB wood composite boards).

A further subject of the present invention—according to a second aspect of the invention—is the oriented strand board or OSB wood composite board of the invention as such, which is obtainable by the method according to the invention and/or which has a treated, especially leveled, surface, preferably flat side surface.

A further subject of the present invention—according to a third aspect of the invention—is, moreover, the production plant for treating, especially levelling, at least one surface, preferably at least one flat side surface, of oriented strand boards.

Yet a further subject of the present invention—according to a fourth aspect of the invention—is, moreover, the use of at least one hotmelt adhesive or of a melt composition and/or sealing composition for increasing the weathering, UV and/or moisture resistance of an oriented strand board and/or for furnishing an oriented strand board with applications properties for the exterior sector.

In this connection, the present invention also relates—according to a fifth aspect of the invention—to the use of at least one hotmelt adhesive or of a melt composition and/or sealing composition for homogenizing and/or levelling the surface, preferably the flat side surface, of an oriented strand board.

Equally, a further subject of the present invention—according to a sixth aspect of the invention—is the inventive use of at least one oriented strand board as or for producing paneling, facings, façade elements, façade panels, construction elements and/or construction boards especially in the (construction) exterior sector and/or in the (construction) interior sector and also, furthermore, as or for producing furniture and/or furniture elements or the like in furniture, shop and/or trade fair construction and also, furthermore, as or for producing packaging elements and/or transport elements especially in the transport or packaging sector.

Lastly, a further subject of the present invention—according to a seventh aspect of the invention—is the construction element or façade element of the invention as such, which comprises or consists of at least one oriented strand board of the invention, as defined in the relevant independent claim.

It will be readily understood that in the description below of the present invention, those embodiments, forms of implementation, advantages, examples or the like which are recited below—for purposes of avoiding unnecessary repetition—in relation only to a single aspect of the invention do of course also apply mutatis mutandis in respect of the other aspects of the invention without the need for any express mention. It is additionally self-evident that where values, numbers and ranges are stated below, the relevant value, number and range recitations should not be understood as imposing any restriction; for the skilled person, it will be understood that in a particular case or particular application, departures from the recited ranges and particulars are possible without the realm of the present invention having been left.

It is the case, moreover, that all value details or parameter details stated hereinafter, or the like, may fundamentally be ascertained or determined using standard/standardized or explicitly recited methods of determination or else otherwise by the methods of determination or measurement that are familiar per se to the person skilled in this field. Unless indicated otherwise, the relevant values or parameters are ascertained under standard conditions (i.e. in particular at a temperature of 20° C. and/or at a pressure of 1013.25 hPa or 1.01325 bar).

It is the case, furthermore, that for all relative or percentage quantity figures recited below, especially those based on weight, these particulars shall be selected and/or combined by the skilled person in the context of the present invention in such a way that the total—where appropriate with incorporation of further components or ingredients, particularly as defined hereinafter—is always 100% or 100 wt. %. This, however, is self-evident to the skilled person.

Furthermore, in relation to the polymers recited for the hotmelt adhesive in the context of the present invention, these polymers may be present in the form of homopolymers or copolymers; in other words, the term "polymers" as used in accordance with the invention encompasses not only homopolymers but also copolymers (i.e. polymers of two or more different monomers). In the case of copolymers, the polymers may take the form, for example, of random copolymers, alternating copolymers, gradient copolymers, block copolymers or graft copolymers. The term "polyolefin", for example, for the purposes of the present invention denotes olefin homopolymers (e.g. polypropylene homopolymers or polyethylene homopolymers) or else olefin copolymers (e.g. ethylene/propylene copolymers); the term "polyethylenes" refers both to polyethylene homopolymers and to polyethylene copolymers, etc. In principle the term "polymers" also embraces the use of functionalized polymers, especially for increasing the functionality of the parent hotmelt adhesive.

This having been established, the present invention is elucidated and described in more detail hereinafter, including on the basis of figure representations and/or drawings which represent preferred embodiments and exemplary embodiments.

A subject of the present invention—according to a first aspect of the present invention—is therefore a method for treating, especially levelling, at least one surface, preferably at least one flat side surface, of oriented strand boards (OSB wood composite boards), wherein the method comprises the following steps in the stated sequence:

a) providing at least one oriented strand board, the oriented strand board comprising at least one surface, preferably at least one flat side surface, having a multiplicity of unevennesses, indentations, cavities, holes and/or craters; then b) applying at least one hotmelt adhesive, especially in the form of a hotmelt adhesive melt, to the at least one surface, especially flat side surface, of the oriented strand board in such a way that at least the unevennesses, indentations, cavities, holes and/or craters are filled and/or filled in at least substantially with the hotmelt adhesive, especially the hotmelt adhesive melt, especially wherein homogenization and/or levelling of the surface, preferably the flat side surface, is brought about; then c) cooling and consolidating, especially curing and/or solidifying, the hotmelt adhesive, especially the hotmelt adhesive melt.

The present invention is therefore aimed at the provision of a specific method whereby, in a targeted way, a treatment, more particularly homogenizing or levelling, is performed in particular on the flat side surface or surfaces of oriented strand boards, using a specific filling composition or coating composition in the form of a hotmelt adhesive or a melt composition and/or sealing composition, where the hotmelt adhesive or the melt composition and/or sealing composition is applied especially in the form of a hotmelt adhesive melt or in the form of a melt for filling in the relevant unevennesses or the like to the surface intended to receive such treatment.

In the context of the present invention, it is possible in this way to fill in the relevant unevennesses, indentations, cavities, holes and/or craters in a way that is effective (i.e. which is durably mechanically stable and protects the OSB board from effects of weathering, UV and moisture), the purpose of a hotmelt adhesive bringing with it both method-specific and product-specific advantages. Indeed, in the context of the present invention, it is possible, in a technically and economically optimized procedure, to carry out filling-in of the surface of an oriented strand board that is durable and is provided with outstanding adhesion properties to the substrate in the form of the OSB board, with the surface that is modified on the basis of the method of the invention and/or coated with the hotmelt adhesive, and therefore the inventively obtained oriented strand boards as such, possessing not only improved visual properties but also sustainably enhanced product properties in respect of increased weathering, UV and moisture resistance. Furthermore, the OSB board obtained in accordance with the invention also has increased chemical resistance. The use of the hotmelt adhesive produces a sustained surface sealing of the OSB board, with the result, for example, that moisture, chemicals, dirt or the like are unable to penetrate the underlying OSB board and therefore that the organic wood constituents are protected from external exposures, in tandem with improved storage stability and weathering stability.

Through the use of a hotmelt adhesive it is possible, for example, to ensure an increase also in the moisture resistance with respect to occasionally severe moisture influence, as may occur, for example, in the exterior sector under heavy rain or the like, so that for this reason as well the oriented strand boards of the invention have an expanded utility spectrum in particular in relation to exterior (construction) applications.

As a result of the surface structure—standardized using a hotmelt adhesive—of the oriented strand board, furthermore, the board systems provided in accordance with the invention are also suitable for use in the interior (construction) sector, as for example in respect of wall and floor systems installed in a visible area, featuring improved moisture resistance, wear resistance and dirt resistance.

As a result of the surface homogenization or levelling undertaken in accordance with the invention, the oriented strand boards of the invention are also amenable to further enhancement of the surface, particularly with regard to full-area lining, coating, laminating or the like, so that in this way as well it is possible to provide visually appealing surface structures which are smooth or even overall; as a result of the uniform surface, furthermore, the underlying assembly is mechanically stabilized with use of a hotmelt adhesive. The oriented strand boards enhanced accordingly can therefore be coated, more particularly surface-coated, lined or laminated, especially over the full area, with a good visual effect, resulting especially in a durable, full-area assembly, this being ensured even after division or orderly cutting of the oriented strand board at any desired point on an orderly cut board, something which is highly relevant in relation, for example, to the provision of fixed dimensions in furniture construction and interior fitment.

In this context, the oriented strand boards or oriented-strand wood composite boards of the invention may be further modified in terms of their surface through the possibility of providing enhanced surfaces based on additional films or foils, such as condensation resin films, as for example melamine resin films or phenolic resin films, something which further extends the utility spectrum or applications spectrum of the oriented strand boards of the invention in the furniture and/or construction sector, since, in the context of the present invention, products can be provided, so to speak, with entirely innovative and custom-tailorable product properties, as indicated above.

Furthermore, the approach taken by the invention, with the use of specific hotmelt adhesives for the levelling or homogenizing of the surface of an oriented strand board, allows the surface to be further functionalized in this respect, in relation, for example to antimicrobial treatment and also to the provision of electrical conductivity or charge dissipation, specific visual (surface) properties, or the like.

On the basis of the hotmelt adhesive applied to the flat side, moreover, it is possible to perform deliberate structuring and/or profiling of the surface, allowing the oriented strand boards of the invention to be furnished, for example, with anti-skid or anti-slip properties.

Through the controlled use of a hotmelt adhesive and its deliberate selection and harmonization, therefore, the method of the invention ultimately ensures that the unevennesses in the region of a surface, especially flat side surface, are filled in optimally, and, moreover, there is optimized adhesion of the filling material used, in the form of the hotmelt adhesive, to the underlying substrate in the form of the oriented strand board. The use of a hotmelt adhesive also makes it possible to carry out further-optimized coating so as to give a particularly uniform or planar surface of the oriented strand board. In view of the targetedly controllable elastomeric and/or thermoplastic properties, furthermore, it is possible for the surface to be further structured and/or profiled, and/or to be further coated with corresponding surface materials, such as decorative foils or the like, which may be applied, for example, to the oriented strand board of the invention.

The use of a hotmelt adhesive, furthermore, leads to a method-related optimization, not least in respect of the relevant apparatus, since the hotmelt adhesive can be applied in a simple way, in particular with heating, and the hotmelt adhesive used, moreover, is at least substantially free from occasionally health-hazardous solvents or the like, so that corresponding extraction devices or the like for the removal of any solvents may also be omitted. In particular, when a hotmelt adhesive is used, there are not residual chemicals or wastes, which are occasionally costly and inconvenient to dispose of. Because of the high fluidity and at least substantially contraction-free curing, it is possible even for relatively deep and/or extensive unevennesses to be filled in completely and durably.

Accordingly, in accordance with the invention, there is also a sustained reduction in the fractions of VOCs (Volatile Organic Compounds) arising from the oriented strand board, such compounds limiting the use of conventional oriented strand boards particularly in the interior sector.

Furthermore, through the procedure according to the invention, it is also possible in particular for the water vapour permeability of the OSB board to be specifically adjusted or reduced, allowing the oriented strand boards of the invention also to be given the function of a vapour barrier, enabling them to be used, for example, in the wet sector or sanitary sector as well. In the context of the present invention, in particular, the SD value (water vapour diffusion-equivalent air layer thickness) of the oriented strand board of the invention is improved or increased accordingly, so that the oriented strand boards of the invention likewise enjoy enhanced moisture protection, since the boards in question may be made diffusion-inhibiting or diffusion-proof. The water vapour diffusion-equivalent air layer thickness here represents a physical measure in construction for the water vapour diffusion resistance of a component or of a component layer, and hence defines its quality as a vapour barrier.

Through the controlled use of hotmelt adhesives it is possible in the context of the present invention for unevennesses or the like on the OSB board to be compensated, with the resulting coating possibly also having a certain elasticity, where appropriate.

Through the purpose-directed use of a hotmelt adhesive, especially in combination with the other measures according to the invention, therefore, the overall effect is to provide an efficient method for enhancing or treating the surface or surfaces, especially flat side surface or surfaces, of oriented strand boards, leading, with high process economy and therefore outstanding cost efficiency, to sustainably improved products in the form of correspondingly treated oriented strand boards having custom-tailored properties, as indicated above.

The method of the invention is described more extensively below, especially in relation to particular embodiments and refinements:

In accordance with the invention, the procedure adopted generally can be such that the unevennesses, indentations, cavities, holes and/or craters are filled and/or filled in at least substantially completely with the hotmelt adhesive, especially the hotmelt adhesive melt.

Moreover, the hotmelt adhesive, especially the hotmelt adhesive melt, ought to be applied at least partially and/or sectionally, preferably over the full area, to the surface, especially flat side surface. Similarly, the hotmelt adhesive, especially the hotmelt adhesive melt, ought to be applied at least substantially continuously and/or uninterruptedly to the surface, especially flat side surface. Consequently there is in particular an at least partial and/or sectional, preferably full-area, filling-in of the unevennesses, indentations, cavities, holes and/or craters, based on the surface, especially flat side surface.

In accordance with the invention, therefore, it is preferred if the unevennesses, indentations, cavities, holes and/or craters are filled or filled in at least substantially completely with the hotmelt adhesive. This ensures an efficient homogenization and/or levelling of the surface. For this purpose, the hotmelt adhesive, especially the hotmelt adhesive melt, may be applied repeatedly and/or the amount of hotmelt adhesive applied may be adapted or adjusted accordingly.

In general, therefore, the hotmelt adhesive, especially the hotmelt adhesive melt, ought to be applied in an amount in the range from 10 g/m$^2$ to 2000 g/m$^2$, especially in the range from 25 g/m$^2$ to 1500 g/m$^2$, preferably in the range from 50 g/m$^2$ to 1000 g/m$^2$, more preferably in the range from 75 g/m$^2$ to 800 g/m$^2$, very preferably in the range from 100 g/m$^2$ to 600 g/m$^2$, based on the surface, especially flat side surface. Where the hotmelt adhesive as such contains no further additives, adjuvants or the like, particularly as defined hereinafter, corresponding application quantities in the range from 80 g/m$^2$ to 120 g/m$^2$ have proved to be suitable. For hotmelt adhesives which do contain further additives, adjuvants or the like, more particularly as defined below, conversely, application amounts in the range from 150 g/m$^2$ to 200 g/m$^2$ are preferred.

In the context of the present invention, therefore, provision is made especially for the hotmelt adhesive, especially the hotmelt adhesive melt, to be applied such that the unevennesses, indentations, cavities, holes and/or craters are filled and/or filled in with the hotmelt adhesive especially so as to form at least one hotmelt adhesive filling, especially hotmelt adhesive levelling filling.

In this connection it is possible, as noted above, for the unevennesses, indentations, cavities, holes and/or craters to be filled and/or filled in at least substantially completely with the hotmelt adhesive. Provision may equally be made in the context of the present invention for the unevennesses, indentations, cavities, holes and/or craters to be filled and/or filled in to an extent of at least 30%, especially at least 50%, preferably at least 70%, more preferably at least 80%, very preferably at least 90%, very preferably at least 95%, especially preferably at least 98%, based on the volume of the unevennesses, indentations, cavities, holes and/or craters, with the hotmelt adhesive.

The unevennesses, indentations, cavities, holes and/or craters in question are formed—without wishing to be tied to this theory—from the interstices generally resulting from the spacing-apart of the irregularly shaped strands of the oriented strand board. As a consequence of the filling-in envisaged in accordance with the invention, therefore, so to speak, in particular the free spaces or defects present in the region of the surface of the oriented strand board are filled in or sealed with the hotmelt adhesive, especially with the hotmelt adhesive melt, and so on this basis there is in particular a homogenization or levelling of the surface in the form of sealing. In accordance with the invention, the surface of the underlying oriented strand board is therefore closed, so to speak, with the hotmelt adhesive, leading similarly not only to the homogenization or levelling in question, but also to the formation of correspondingly improved properties in particular in relation to enhanced weathering, UV and/or moisture resistance on the part of the oriented strand board treated accordingly.

In accordance with the invention, provision may be made in particular for the hotmelt adhesive filling to be at least partially and/or sectionally interspersed and/or optionally interrupted by strands which delimit or form the unevennesses, indentations, cavities, holes and/or craters. In particular, the strands which delimit or form the unevennesses, indentations, cavities, holes and/or craters may project at least partially and/or sectionally into the hotmelt adhesive filling.

The hotmelt adhesive filling here may have a thickness in the range from 0.2 mm to 50 mm, especially in the range from 0.5 mm to 25 mm, preferably in the range from 1 mm to 10 mm, more preferably in the range from 1 mm to 5 mm. The aforementioned thickness figures are based in general on the hotmelt adhesive filling layer interspersed, so to speak, with the strands.

In accordance with the invention it may fundamentally be the case, in relation to the hotmelt adhesive filling layer which may be obtained, for example, in a first application, that this layer optionally also has passages containing the strands in question, or for this filling layer as such as yet not to form a completely uniform or leveled surface. In that case, the application of the hotmelt adhesive may be repeated or the quantity of hotmelt adhesive to be applied may be increased. In particular it is possible, as observed later on below, as part of a second application of hotmelt adhesive, for example, for at least one further hotmelt adhesive filling or hotmelt adhesive layer, more particularly hotmelt adhesive capping layer, to be applied. In accordance with the invention, however, provision may also be made for the hotmelt adhesive filling itself to form a closed hotmelt adhesive layer, especially in the region of its surface, so to speak, and so to form a homogenized or leveled (final) layer. This may be ensured, for example, through the selection of correspondingly high quantities of hotmelt adhesive applied.

In this connection, provision may be made in particular in accordance with the invention for the hotmelt adhesive, especially the hotmelt adhesive melt, to be applied, in order to form the hotmelt adhesive filling, in an amount in the range from 5 g/m$^2$ to 1000 g/m$^2$, especially in the range from 10 g/m$^2$ to 800 g/m$^2$, preferably in the range from 20 g/m$^2$ to 600 g/m$^2$, more preferably in the range from 40 g/m$^2$ to 600 g/m$^2$, very preferably in the range from 60 g/m$^2$ to 400 g/m$^2$, based on the surface, especially flat side surface.

In the context of the present invention, furthermore, a procedure adopted may be such that the hotmelt adhesive, especially the hotmelt adhesive melt, is applied, moreover, such that the surface, especially flat side surface, and/or the hotmelt adhesive filling is or are coated and/or filmed at least partially and/or sectionally, preferably over the full area, with the hotmelt adhesive, more particularly with the hotmelt adhesive melt, especially such as to result in at least one hotmelt adhesive layer, especially hotmelt adhesive capping layer, disposed on the surface, especially flat side surface, and/or on the hotmelt adhesive filling.

The application of the hotmelt adhesive, especially the hotmelt adhesive melt, to form the hotmelt adhesive layer in question may in accordance with the invention be carried out in particular in addition to the above-described application of the hotmelt adhesive especially for producing a hotmelt filling. In the case of the hotmelt adhesive layer, especially additionally applied hotmelt adhesive layer, the layer in question may especially be a capping layer, in which case the hotmelt adhesive layer preferably covers or seals the surface, especially flat side surface, of the oriented strand board completely. The hotmelt adhesive layer is therefore, in particular, a (capping) layer for ensuring a smooth and/or planar and at least substantially fully sealed surface, especially flat side surface, of the oriented strand board.

The hotmelt adhesive layer may in principle also be produced at the same time as or in a joint method step with the application of the hotmelt adhesive filling, especially wherein in that case the hotmelt adhesive filling on the one hand and hotmelt adhesive on the other form a joint layer or are present in the form of a joint layer. Furthermore, the hotmelt adhesive layer may also be applied subsequently or in a separate method step, especially wherein the hotmelt adhesive layer in that case is applied, so to speak, in the form of an after coating or after-film deposition.

The hotmelt adhesive layer may be at least substantially closed in design and/or at least substantially unpenetrated in design. Equally, provision may be made in accordance with the invention for the hotmelt adhesive layer at least substantially to have no strands which delimit or form the unevennesses, indentations, cavities, holes or craters. The hotmelt adhesive layer may therefore especially be a (capping) layer which is homogeneous and/or comprises at least substantially only the hotmelt adhesive as such. By this means, in addition to optimized optical surface properties, a further-improved sealing of the oriented strand board is also ensured, in tandem in particular with a further improved weathering, UV and/or moisture resistance.

In general, the hotmelt adhesive layer may have a thickness in the range from 0.1 mm to 30 mm, especially in the range from 0.2 mm to 20 mm, preferably in the range from 0.5 mm to 10 mm, more preferably in the range from 0.75 mm to 5 mm, very preferably in the range from 1 mm to 3 mm. The above thickness figures are based in particular on the hotmelt adhesive layer which is present in applied form on the filled-in OSB board or the OSB board comprising the hotmelt adhesive filling.

In this connection, the hotmelt adhesive, especially the hotmelt adhesive melt, may be applied to form the hotmelt adhesive layer in an amount in the range from 5 $g/m^2$ to 1000 $g/m^2$ especially in the range from 10 $g/m^2$ to 800 $g/m^2$, preferably in the range from 20 $g/m^2$ to 600 $g/m^2$, more preferably in the range from 40 $g/m^2$ to 600 $g/m^2$, very preferably in the range from 60 $g/m^2$ to 400 $g/m^2$, especially preferably in the range from 60 $g/m^2$ to 300 $g/m^2$, based on the surface, especially flat side surface.

The present invention accordingly also relates to a method for treating, especially levelling, at least one surface, preferably at least one flat side surface, of oriented strand boards (OSB wood composite boards), especially a method as defined above, wherein the method comprises the following steps in the stated order:

a) providing at least one oriented strand board, the oriented strand board comprising at least one surface, preferably at least one flat side surface, having a multiplicity of unevennesses, indentations, cavities, holes and/or craters; then
b) applying at least one hotmelt adhesive, especially in the form of a hotmelt adhesive melt, to the surface, especially flat side surface, of the oriented strand board, wherein
   b1) first the hotmelt adhesive, especially the hotmelt adhesive melt, is applied such that the unevennesses, indentations, cavities, holes and/or craters are filled and/or filled in with the hotmelt adhesive, especially so as to form at least one hotmelt adhesive filling, preferably hotmelt adhesive levelling filling, especially wherein homogenization and/or levelling of the surface, preferably the flat side surface, is brought about, and
   b2) subsequently the hotmelt adhesive, especially the hotmelt adhesive melt, is applied such that the surface, especially flat side surface, and/or the hotmelt adhesive filling is coated and/or filmed, moreover, at least partially and/or sectionally, preferably over the full area, with the hotmelt adhesive, especially with the hotmelt adhesive melt, especially wherein there results at least one hotmelt adhesive layer, especially hotmelt adhesive capping layer, disposed on the surface, especially flat side surface, and/or on the hotmelt adhesive filling;
c) optionally cooling and consolidating, especially curing and/or solidifying, the hotmelt adhesive, especially the hotmelt adhesive melt, after implementation of step b1) and/or b2).

With regard to the sequence of the respective method steps, it is possible in particular to adopt a procedure wherein the filling or filling-in of the unevennesses, indentations, cavities, holes and/or craters with the hotmelt adhesive, especially the formation of the hotmelt adhesive filling, or step b1), on the one hand, and the coating or filming of the surface, preferably flat side surface, especially the formation of the hotmelt adhesive layer, or step b2), on the other hand, are carried out in a joint method step and/or simultaneously, or else may be carried out in separate method steps or consecutively. In this context, a particular procedure is that wherein first of all the filling and/or filling-in of the unevennesses, indentations, cavities, holes and/or craters with the hotmelt adhesive, especially the formation of the hotmelt adhesive filling, or step b1), is carried out, optionally followed by cooling and consolidation of the hotmelt adhesive, and subsequently the coating or filming of the surface, preferably flat side surface, especially the formation of the hotmelt adhesive layer, or step b2), is carried out, optionally followed by cooling and consolidation of the hotmelt adhesive.

In this context, for the filling or filling-in of the unevennesses, indentations, cavities, holes and/or craters, especially for the forming of the hotmelt adhesive filling, or in step b1), on the one hand, and for the coating or filming of the surface, preferably flat side surface, or the hotmelt adhesive filling, especially for the forming of the hotmelt adhesive layer, or in step b2), on the other hand, it is possible to use the same hotmelt adhesive in each case and/or to use identical hotmelt adhesives in each case, especially as defined hereinafter.

With regard to the use of identical hotmelt adhesives, there is especially a further simplification of the method regime. Through the use of hotmelt adhesives which are different from one another it is possible, conversely, for the particular properties of the hotmelt adhesive filling on the one hand and of the hotmelt adhesive layer on the other to be specifically adjusted or custom-tailored.

For the purposes of the present invention it is possible in principle to use a multiplicity of hotmelt adhesives, as indicated below.

The hotmelt adhesives used in accordance with the invention, which are also referred to synonymously as hot-applied adhesives, melt-applied adhesives or hotmelts, are generally products which are at least substantially solvent-free and solid at room temperature, and which take on a fluid or liquid state on heating or in the hot state, allowing them to be applied on this basis to the relevant surface, especially flat side surface, of the oriented strand board, for the purpose of filling-in the unevennesses or the like. On subsequent cooling with accompanying consolidation or curing of the hotmelt adhesive, a durable filling or coating of the oriented strand board is then formed on the thus-treated surface of the OSB board.

The hotmelt adhesives used in accordance with the invention are generally associated with the advantage of rapid working in conjunction with low materials price, and, moreover, as indicated above, a wide variety of different materials can be used. Another advantage in this context is that the hotmelt adhesives employed and also the fillings and coatings produced with them are amenable to subsequent working or modification, as part of further coatings, linings, surface-coatings or the like, for example. Moreover, the hotmelt adhesives used exhibit high stability and resistance towards weathering, UV radiation and moisture, leading correspondingly to improved properties on the part of oriented strand boards provided in accordance with the invention.

It has generally proved to be advantageous in accordance with the invention if the hotmelt adhesive is a thermoplastic and/or one-component hotmelt adhesive, especially a one-component (1K) hotmelt adhesive.

In general, the hotmelt adhesive ought to be at least substantially water-free and/or solvent-free. In this connection, the hotmelt adhesive ought to have a water content and/or solvent content of at most 10 wt. %, especially at most 5 wt. %, preferably at most 2 wt. %, more preferably at most 1 wt. %, very preferably at most 0.5 wt. %, especially preferably at most 0.1 wt. %, based on the hotmelt adhesive. By this means the processing properties of the hotmelt adhesive used in accordance with the invention are improved. This ensures more particularly that the hotmelt adhesive at least substantially does not penetrate the fibre structure of the woodchips on which the wood-based material board is based, thereby preventing unwanted swelling of the material.

Particularly good filling and coating results are obtained in accordance with the invention if the hotmelt adhesive is a reactive hotmelt adhesive, especially a thermoplastic or one-component reactive hotmelt adhesive, preferably a one-component reactive hotmelt adhesive.

A particular feature of reactive hotmelt adhesives of the kind used with particular preference in accordance with the invention is that they possess chemically reactive functional groups which, especially during and after the application, under the influence of heat, radiation or moisture, for example, lead to (subsequent) crosslinking, thereby further improving the adhesion or adhesive connection to the substrate in the form of the oriented strand board.

In this connection, provision may especially be made in accordance with the invention for the reactive hotmelt adhesive to be a moisture-crosslinking, heat-crosslinking and/or radiation-crosslinking hotmelt adhesive, especially a moisture-crosslinking and/or radiation-crosslinking, preferably a moisture-crosslinking, hotmelt adhesive.

In the processing of reactive hotmelt adhesives—without wishing to be tied to this theory—there is generally, after application to the oriented strand board to be worked on, not only a physical setting but also a further chemical reaction to form high molecular mass polymers with high cohesion, and/or with formation of additional crosslink bonds and adhesive bonds, especially as a consequence of chemical reactions, including reactions with the surface of the oriented strand boards to be treated. In this way, for reactive hotmelt adhesives, it is possible to achieve very good coating and filling properties, high temperature stabilities in conjunction with good low-temperature flexibility, and also a high level of resistance even towards chemicals or towards environmental effects.

In their application, therefore, reactive hotmelt adhesives also exhibit advantages in that, owing to the chemical post-crosslinking and formation of chemical adhesive bonds or contact bonds, a reactive hotmelt adhesive cured accordingly can no longer be melted, at least substantially, by exposure to heat, meaning that in this respect as well there is high resistance or durability. Furthermore, reactive hotmelt adhesives, especially by virtue of the physical curing that, so to speak, precedes subsequent crosslinking, likewise exhibit rapid processing properties without lengthy drying phases, this being associated with process-related advantages.

In general, the reactive hotmelt adhesive has chemically reactive groups. These chemically reactive groups may be selected from isocyanate groups, silane groups, epoxide groups and reactive double or multiple bonds (especially double or multiple C—C bonds, such as, for example urethane groups having reactive double or multiple bonds, especially double or multiple C—C bonds) and also combinations thereof, preferably isocyanate groups and silane groups. In particular, the chemically reactive groups are terminal, or located terminally in the molecular framework of the reactive hotmelt adhesive. The chemically reactive groups in question lead to defined (subsequent) crosslinking, including with formation of adhesive bonds or contact bonds with the oriented strand board surface to be treated, as part of the use of the hotmelt adhesive, again without wishing to be tied to this theory.

In accordance with the invention it is especially advantageous if the reactive hotmelt adhesive is selected from the group of (i) reactive, especially moisture-crosslinking polyurethanes (PUR), preferably isocyanate group-functionalized and/or isocyanate group-containing polyurethanes, more preferably isocyanate-terminated polyurethanes; (ii) reactive, especially moisture-crosslinking polyolefins (POR), preferably silane group-functionalized and/or silane group-containing polyolefins, more preferably silane group-grafted polyolefins; (iii) reactive, especially radiation-crosslinking, preferably UV-crosslinking poly(meth)acrylates, preferably urethane group-functionalized and/or urethane group-containing poly(meth)acrylates, and also mixtures and combinations thereof, more preferably from the group of (i) reactive, especially moisture-crosslinking polyurethanes (PUR), preferably isocyanate group-functionalized and/or isocyanate group-containing polyurethanes, more preferably isocyanate-terminated polyurethanes; (ii) reactive, especially moisture-crosslinking polyolefins (POR), preferably silane group-functionalized and/or silane group-containing polyolefins, more preferably silane group-grafted polyolefins; and also mixtures and combinations thereof.

The reactive hotmelt adhesives, especially one-component reactive hotmelt adhesives, used preferably in accordance with the invention, such as, in particular, reactive, preferably moisture-crosslinking polyurethanes (PUR) are notable all in all for high UV stability in conjunction with high mechanical stability or strength. Moreover, in the course of cooling and/or consolidating, there is no unduly exothermic reaction, and so the underlying oriented strand board, or the filling as such, is not affected by additional and occasionally difficult-to-control heat exposure during application and consolidation of the applied hotmelt adhesive, this likewise being beneficial to the formation of an effective adhesive bond and, furthermore, counteracting any unwanted warping of the oriented strand board, by preventing excessive one-sided evolution of heat.

Furthermore, the hotmelt adhesives in question may in principle also be used in a continuous process or an in-line process, in which case the oriented strand boards thus treated are available immediately for further processing, as for example for further coating with decorative foils or the like.

The hotmelt adhesives in question, moreover, after the cooling and the consolidating and/or after complete crosslinking, owing to the freedom from blocking, are not tacky, and so there is also no occasionally disadvantageous surface stickiness; however, by virtue of the physical properties intrinsic to the reactive hotmelt adhesives, there is nevertheless generally an assurance of high slip resistances or good anti-slip properties on the part of the surfaces in question.

Furthermore, the reactive hotmelt adhesives in question may have coating materials, for example, laid on them, such as (decorative) foils or the like, while in the thermoplastic phase, in other words up to the final crosslinking of the adhesive, by virtue of the residual tack. Also possible, furthermore, is the incorporation of particulate structures, such as glitters for decorative purposes, in the thermoplastic phase.

In view of the underlying subsequent crosslinking, moreover, there is an additional adhesive bonding of the reactive hotmelt adhesives to the interface or surface of the oriented strand board, something which also increases the strength. In this regard, moisture-crosslinking reactive hotmelt adhesives are especially advantageous, since it is possible for the moisture required for crosslinking to be provided, for example, from the strands, which contain residual moisture. Moreover, in particular, the reactive PUR hotmelt adhesives recited above have a high chemical resistance in particular as well as a high temperature stability.

Generally speaking, features of the hotmelt adhesives or melt compositions used in accordance with the invention include the fact that in the melted state they have a high fluidity and/or are at least substantially blocking-free soon after application to the surface, especially flat side surface. These qualities have proved to be advantageous especially with regard to subsequent processing or further processing and/or to the storage of the oriented strand boards provided in accordance with the invention. In particular, the oriented strand boards provided in accordance with the invention may be further-processed and/or stored soon after application of the hotmelt adhesive, without any unwanted sticking-together or the like occurring in the course of such processing/storage.

According to an alternative although less preferred embodiment of the present invention, moreover, provision may be made for the hotmelt adhesive to be a non-reactive hotmelt adhesive, more particularly a thermoplastic and/or one-component non-reactive hotmelt adhesive, preferably a one-component non-reactive hotmelt adhesive.

Non-reactive hotmelt adhesives as may be used in the context of the present invention generally have a short application time or setting time. In the case of non-reactive hotmelt adhesives, the actual bond is significantly physical, resulting from the consolidation that takes place to the applied hotmelt adhesive melt which is present on cooling of the applied hotmelt adhesive. In contrast to the reactive hotmelt adhesives, non-reactive hotmelt adhesives may in principle be melted again after consolidation has taken place. In this context, as part of the approach according to the invention, it is possible to contemplate the use of non-reactive hotmelt adhesives against the background, for example, of subsequent coating or laminating of the oriented strand board provided in accordance with the invention.

In general, in the context of the present invention, the non-reactive hotmelt adhesive may be selected from the group of (i) ethylene-vinyl acetates (EVA polymers); (ii) polyolefins (PO), especially polyethylenes (PE), polypropylenes (PP) and atactic polyolefins (APAO); (iii) polyamides (PA); (iv) thermoplastic polyurethanes (TPU); (v) polyurethanes (PU); (vi) (meth)acrylates; (vii) polyesters (PES); and also mixtures and combinations thereof, more preferably from the group of (i) ethylene-vinyl acetates (EVA polymers); (ii) polyolefins (PO); (iii) polyamides (PA); (iv) thermoplastic polyurethanes (TPU); and also mixtures and combinations thereof.

Furthermore, provision may also be made in accordance with the invention for the hotmelt adhesive to be a hotmelt adhesive based on natural raw materials, especially polylactic acid (PLA). For further statements regarding the hotmelt adhesives based on natural raw materials that can be used in accordance with the invention, reference may be made to EP 2 781 573 and also to the parallel DE 10 2013 004 909 and also to US 2015 191 635, whose respective disclosure content is hereby incorporated in full by reference.

In the context of the present invention it is possible, moreover, for the hotmelt adhesive to comprise or consist of a mixture or combination of at least two different hotmelt adhesives, especially as defined above. The hotmelt adhesive may especially comprise or consist of a mixture or combination of at least one reactive hotmelt adhesive, especially as defined above, and at least one non-reactive hotmelt adhesive, especially as defined above. On this basis as well it is possible to adapt or custom-tailor the corresponding applications properties and product properties of the hotmelt adhesive used, particularly in relation to the particular application scenario and particular use.

In the context of the present invention, the reactive hotmelt adhesive used may be, for example, the commercially available product Jowatherm-Reaktant® 602.35, sold by Jowat SE. In accordance with the invention, moreover, the non-reactive hotmelt adhesive used may be a polyolefin-based hotmelt adhesive, more particularly in the form of the commercially available product Jowatherm® EP 60 287.90, which is likewise sold by Jowat SE. Moreover, a non-reactive EVA hotmelt adhesive in the form of the commercially available product Jowatherm® 287.10 sold by Jowat SE may be used.

With regard, moreover, to the hotmelt adhesive used in the context of the present invention, it ought to be in the solid state at room temperature (20° C.) under ambient pressure (1013.25 hPa).

Furthermore, the hotmelt adhesive ought to have a softening point and/or softening range, more particularly as determined by ring and ball, preferably determined according to DIN EN 1238:2011-07, in the range from 30° C. to 200° C., especially in the range from 40° C. to 100° C., preferably in the range from 50° C. to 90° C., more preferably in the range from 55° C. to 80° C.

In this context, the hotmelt adhesive ought to have a softening point or softening range, especially as determined by ring and ball, preferably determined according to DIN EN 1238:2011-07, of at least 30° C., especially at least 40° C., preferably at least 50° C., more preferably at least 55° C., very preferably at least 60° C.

It is of advantage, moreover, in the context of the present invention if the hotmelt adhesive has a melting point, especially determined by differential scanning calorimetry (DSC) preferably determined according to DIN 53765: 1994-03, in the range from 55° C. to 275° C., especially in the range from 65° C. to 225° C., preferably in the range from 70° C. to 175° C.

In this context provision may likewise be made for the hotmelt adhesive to have a processing temperature, especially determined by differential scanning calorimetry (DSC), preferably determined according to DIN 53765: 1994-03, in the range from 80° C. to 300° C., especially in the range from 90° C. to 250° C., preferably in the range from 95° C. to 200° C.

Furthermore, the hotmelt adhesive ought to have a viscosity, especially dynamic viscosity and/or especially determined according to DIN EN ISO 3219:1994-10, and/or especially in the temperature range from 95° C. to 200° C., in the range from 5000 mPas to 150 000 mPas, especially in the range from 7500 mPas to 125 000 mPas, preferably in the range from 10 000 mPas to 100 000 mPas.

Similarly, the hotmelt adhesive ought to have a density p, especially determined at a temperature of 20° C. and/or especially determined according to DIN 51757:2011-01, in the range from 0.5 g/cm$^3$ to 2.5 g/cm$^3$, especially in the range from 0.6 g/cm$^3$ to 2.3 g/cm$^3$, preferably in the range from 0.7 g/cm$^3$ to 2.1 g/cm$^3$, more preferably in the range from 0.8 g/cm$^3$ to 2 g/cm$^3$.

Provision may be made, moreover, for the hotmelt adhesive, after its application and/or after its cooling and consolidation, especially curing and/or solidification to be at least substantially blocking-free.

Equally, provision may optionally be made for the hotmelt adhesive, after its application and/or after its cooling and consolidation, especially curing and/or solidification, to have thermoplastic and/or elastomeric properties.

The aforementioned properties and parameters of the hotmelt adhesive used in accordance with the invention lead in particular to application-specific and/or processing-specific properties and advantages, particularly with regard to the melting behaviour, the fluidity and the behaviour on application to the oriented strand board to be treated.

According to one embodiment of the invention, the hotmelt adhesive may comprise at least one adhesion promoter or primer. In this regard, the adhesion promoter or primer may be selected from the group consisting of silicon oxides, silanes, silicas, siliceous earths, and also mixtures and combinations thereof. The hotmelt adhesive may especially comprise the adhesion promoter or primer in amounts in the range from 1 wt. % to 30 wt. %, especially in the range from 2 wt. % to 20 wt. %, preferably in the range from 5 wt. % to 10 wt. %, based on the hotmelt adhesive. Through the targeted use of an adhesion promoter or primer, it is possible first to improve the adhesion of the hotmelt adhesive in respect of the oriented strand board to be treated. Secondly, the hotmelt adhesive used may be equipped with appropriate properties, in respect of the provision of a primer function, for example, for any laminating, lining, coating, painting or the like that follows the surface treatment of the oriented strand board. In particular, therefore, the adhesion properties can be controlled in relation to subsequent coatings. The hotmelt adhesive may be accorded a primer function, in particular, in the case of difficult-to-bond substrates, and/or the function of an adhesion base for subsequent coatings or the like—in relation, for example, to the use of mineral or synthetic resin-based coatings, such as corresponding renders or the like. Furthermore, the use of an adhesion promoter or primer allows the porosity of the surface of the hotmelt adhesive filling or hotmelt adhesive layer to be tailored.

The hotmelt adhesive may further comprise at least one additive. This additive may be selected from the group consisting of plasticizers, high-boiling organic oils, esters or other additives serving for plasticization, stabilizers, especially UV stabilizers, antioxidants, acid scavengers, especially nanoparticulate fillers, ageing inhibitors and also mixtures or combinations thereof. In this respect the hotmelt adhesive may comprise the additive for example in amounts in the range from 1 wt. % to 60 wt. %, especially in the range from 5 wt. % to 50 wt. %, preferably in the range from 10 wt. % to 40 wt. %, based on the hotmelt adhesive. By this means it is possible to further adjust or dictate the properties of the hotmelt adhesive used in accordance with the invention.

In particular the hotmelt adhesive, moreover, may comprise at least one non-reactive polymer, resin and/or wax, especially a natural, synthetic or chemically modified (semi-synthetic) wax. In this connection, the hotmelt adhesive may comprise the non-reactive polymer, resin and/or wax in amounts in the range from 0.5 wt. % to 15 wt. %, especially in the range from 1 wt. % to 10 wt. %, preferably in the range from 1.5 wt. % to 5 wt. %, based on the hotmelt adhesive. By this means it is also possible in particular to make further adjustments to the fluidity of the hotmelt adhesive, this leading, in particular, to improved applications properties when the hotmelt adhesive is applied to the surface, especially flat side surface, of the oriented strand board.

The hotmelt adhesive may likewise comprise at least one functionalizing component. In this connection, the functionalizing component may be selected from the group consisting of electrically conductive substances, anti-microbial, anti-mycotic and/or fungicidal substances and also mixtures and combinations thereof. The hotmelt adhesive may especially comprise the functionalizing component in amounts in the range from 0.1 wt. % to 10 wt. %, especially in the range from 0.2 wt. % to 5 wt. %, preferably in the range from 0.5 wt. % to 3 wt. %, based on the hotmelt adhesive.

The hotmelt adhesive may further comprise at least one dye and/or at least one colour pigment. In this connection, the dye and/or the colour pigment may be selected from the group of organic pigment dyes, inorganic pigment dyes, and also mixtures and combinations thereof. The hotmelt adhesive may comprise the dye and/or the colour pigment in amounts in the range from 0.1 wt. % to 30 wt. %, especially in the range from 0.5 wt. % to 20 wt. %, preferably in the range from 1 wt. % to 10 wt. %, based on the hotmelt adhesive. By this means it is possible to equip the hotmelt adhesive purposively with specific optical properties, thus allowing an oriented strand board treated on this basis to acquire further decorative qualities as well.

In the context of the present invention it is especially preferred if the hotmelt adhesive, especially the hotmelt adhesive melt, is applied by spraying, nozzle application, knife coating, roll application, calendering, printing processes or extrusion, especially by nozzle application and/or roll application, preferably roll application, to the surface, especially flat side surface.

In accordance with the invention a possible procedure in particular is that the hotmelt adhesive, especially the hotmelt adhesive melt, is applied by nozzle application, especially slot nozzle application, to the surface, especially flat side surface.

In accordance with the invention, however, particularly good results are achieved if the hotmelt adhesive, especially the hotmelt adhesive melt, is applied by roll application, especially by at least one hotmelt adhesive metering roll and/or hotmelt adhesive applicator roll, to the surface, especially flat side surface. In this context a particular possible procedure is that the hotmelt adhesive metering roll and/or hotmelt adhesive applicator roll are or is operated in co-rotation or counter-rotation to the process direction or application direction, especially in co-rotation or counter-rotation to the transport direction or advance direction of the oriented strand board. Through the controlled procedure whereby the hotmelt adhesive metering roll and/or hotmelt adhesive applicator roll, independently of one another, are or is operated in co-rotation or counter-rotation to the process or application direction or to the transport direction and/or advance direction of the oriented strand board, it is possible to tailor or dictate the amount of hotmelt adhesive applied per unit area.

In this context, provision may also be made in accordance with the invention for the amount applied, especially the amount applied per unit area, of the hotmelt adhesive, especially the hotmelt adhesive melt, to be adjusted or dictated via the rotational speed or peripheral speed of the hotmelt adhesive metering roll and/or of the hotmelt adhesive applicator roll, preferably via the ratio of the rotational speed or peripheral speed of the hotmelt adhesive metering roll and/or of the hotmelt adhesive applicator roll to the application speed, especially transport speed or advance speed, of the oriented strand board. The application speed here refers in particular to the length-based application of the hotmelt adhesive per unit time to the oriented strand board. On this basis, as part of the present invention, a predetermined amount of hotmelt adhesive can be applied to a defined area of the oriented strand board. In accordance with the invention, therefore, the specific procedure ensures that there is uniform application of the hotmelt adhesive in defined quantities per unit area on the underlying oriented strand board.

In accordance with the invention, for example, a hotmelt adhesive applicator roll, especially with a doctor blade system, can be used. In this way, particularly defined and uniform application of the required amount of hotmelt adhesive is ensured.

In accordance with the invention, for example, heatable hotmelt adhesive metering rolls and/or heatable hotmelt adhesive applicator rolls, for example, in particular, heatable hotmelt adhesive applicator rolls with separate hotmelt adhesive metering rolls, or, in particular, heatable hotmelt adhesive applicator rolls with doctor blade systems, can be used for applying the quantities of hotmelt adhesive that are provided in accordance with the invention.

As noted above, it is possible by adjusting the ratio of advance speed of the oriented strand board to be coated to the rotary speed or peripheral speed, in particular, of the applicator roll to dictate or adjust the amount of hotmelt adhesive, taking account also of the different viscosities and/or rheological properties inherent in the respective melts.

In the context of the method of the invention, a particular procedure is that wherein the hotmelt adhesive, especially the hotmelt adhesive melt, is applied at a temperature above the softening point or softening range or above the melting point, preferably above the melting point, of the hotmelt adhesive to the surface, especially flat side surface. This ensures particularly uniform and complete filling-in of the unevennesses, indentations, cavities, holes and/or craters, since the melt in the fluid state is able to penetrate the surface particularly effectively, without giving rise to swelling of the woodchips. By this means it is also possible in particular to achieve uniform and homogeneous coating of the oriented strand board with the relevant hotmelt adhesive, and high adhesion with respect to the substrate (i.e. the underlying oriented strand board) is also ensured.

In this connection, provision is made especially in accordance with the invention for the hotmelt adhesive, especially the hotmelt adhesive melt, to be applied at a temperature (i.e., in particular, temperature of the hotmelt adhesive) in the range from 40° C. to 300° C., especially in the range from 60° C. to 250° C., preferably in the range from 80° C. to 220° C., more preferably in the range from 90° C. to 200° C., very preferably in the range from 95° C. to 190° C., to the surface, especially flat side surface.

The hotmelt adhesive, especially the hotmelt adhesive melt, may especially be applied at a temperature (i.e. temperature of the hotmelt adhesive) of at least 40° C., especially at least 60° C., preferably at least 80° C., more preferably at least 90° C., very preferably at least 95° C., to the surface, especially flat side surface.

In relation in particular to further optimization of the application of hotmelt adhesive, moreover, a procedure may be adopted in accordance with the invention whereby (i) the application of the hotmelt adhesive, especially the hotmelt adhesive melt, to the surface, especially flat side surface, of the oriented strand board, and/or step b), and/or (ii) the filling and/or filling-in of the unevennesses, indentations, cavities, holes and/or craters with the hotmelt adhesive, especially the formation of the hotmelt adhesive filling, and/or step b1), and/or (iii) the coating and/or filming of the surface, preferably flat side surface, especially the formation of the hotmelt adhesive layer, and/or step b2), is or are independently of one another, in particular, carried out or repeated a number of times, more particularly once, twice, three times or more.

By this means it is possible to provide particularly uniform and/or complete filling-in and also uniform and homogeneous coating of the underlying oriented strand board, not least in the case that the oriented strand board to be treated possesses a disproportionately large number of and/or correspondingly large or voluminous unevennesses, indentations, cavities, holes and/or craters. The relevant repetitions of the respective method steps may be accomplished by corresponding return and/or re-supply of the oriented strand board intended for re-treatment to the hotmelt adhesive metering roll and/or the hotmelt adhesive applicator roll. Alternatively, in the context of the method regime of the invention, it is also possible to use a plurality of hotmelt adhesive metering rolls and/or hotmelt adhesive applicator rolls, arranged one after another or consecutively. In this case, in accordance with the invention, the procedure is also possible wherein before the hotmelt adhesive is applied again, the hotmelt adhesive melt applied beforehand is first of all at least partly cooled and/or at least partly consolidated. An alternative possible procedure, however, is that wherein the further application of the hotmelt adhesive takes place to the hotmelt adhesive which has already been applied and has not yet (fully) cooled and/or is not yet (fully) consolidated.

In a further possible procedure in accordance with the invention, before the application of the hotmelt adhesive, especially the hotmelt adhesive melt, to the surface, especially flat side surface, and/or before step b), especially before step b1) and/or before step b2), preferably before step b1), and/or after step (a), moreover, a smoothing is carried out, especially an abrading, preferably calibration abrading, of the surface, especially flat side surface. By this means it is possible to reduce in size and/or homogenize the unevennesses, indentations, cavities, holes and/or craters, especially by ablation in particular of (surface) material and/or strand material of the oriented strand board to be treated, prior to the actual equipping with the hotmelt adhesive. Consequently, all in all, it is possible to realize even more uniform filling-in and/or coating with the hotmelt adhesive, and particularly uniform and homogeneous surfaces can be provided. In particular, the smoothing of the surface, especially flat side surface, which takes place optionally prior to the application of hotmelt adhesive, leads to a reduction in the amount of hotmelt adhesive that need be applied. Smoothing may be carried out, for example, using an abrading roll or the like. Smoothing may optionally be repeated until the surface, especially flat side surface, of the oriented strand board has the desired smoothness.

In this context, after the smoothing, especially the abrading, preferably calibration abrading, of the surface, especially flat side surface, it is also possible for cleaning of the surface, especially flat side surface, to be carried out, especially for removing material which has been abraded and/or ablated beforehand. For this purpose it is possible in particular to use corresponding brush rolls, suction devices or the like. The cleaning of the surface ought also to take place before the hotmelt adhesive, especially the hotmelt adhesive melt, is applied.

Furthermore, as part of the method of the invention, moreover, before the application of the hotmelt adhesive, especially the hotmelt adhesive melt, to the surface, especially flat side surface, and/or before step b), especially before step b1) and/or before step b2), preferably before step b1) and/or after step (a) and/or after the smoothing of the surface, especially flat side surface, there may be preheating of the surface, especially flat side surface, and/or of the OSB board as such. In this connection, the surface, especially flat side surface, and/or the OSB board may be heated to a temperature in the range from 25° C. to 200° C., especially in the range from 30° C. to 150° C., preferably in the range from 40° C. to 125° C., more preferably in the range from 50° C. to 100° C. In particular, the surface, especially flat side surface, and/or the OSB board may be heated to a temperature of at least 25° C., especially at least 30° C., preferably at least 40° C., more preferably at least 50° C. On this basis, uniform application and processing conditions can be ensured throughout the procedure. Moreover, the preheating results in improved wetting and penetration characteristics of the applied hotmelt adhesive, especially the hotmelt adhesive melt, in respect of the surface to be coated, especially flat side surface, of the oriented strand board, since premature curing is prevented, thereby further enhancing the quality of the filled and/or coated surface.

According to the present invention, moreover, a procedure may be followed wherein before the application of the hotmelt adhesive, especially the hotmelt adhesive melt, to the surface, especially flat side surface, and/or before step b), especially before step b1) and/or before step b2), preferably before step b1) and/or after step (a) and/or after the smoothing of the surface, especially flat side surface, there may be preferably automated capture and evaluation, especially optical capture and evaluation, preferably opto-electronic capture and evaluation, of the surface, especially flat side surface, preferably of the unevennesses, indentations, cavities, holes and/or craters. In this case, in accordance with the invention, one particular possible procedure is that wherein subsequently there is differentiated application of the hotmelt adhesive, especially of the hotmelt adhesive melt, and/or application thereof that is adapted, preferably quantitatively adapted, to the captured and analysed surface, especially flat side surface, preferably to the captured and analysed unevennesses, indentations, cavities, holes and/or craters.

For this purpose it is possible, for example, to use corresponding opto-electronic capture and/or analysis equipment. An appropriately differentiated or site-specific application of hotmelt adhesive may be carried out, for example, using corresponding nozzle application equipment or by sectional application of the hotmelt adhesive by means of a hotmelt adhesive metering roll and/or hotmelt adhesive applicator roll or the like. In this connection, one particular possible procedure is that wherein correspondingly larger applied quantities of the hotmelt adhesive are used for regions having particularly large or high-volume unevennesses, indentations, cavities, holes and/or craters, whereas for regions of the surface to be treated, especially flat side surface, having correspondingly few or small-volume unevennesses, indentations, cavities, holes and/or craters, correspondingly smaller application quantities of hotmelt adhesive are employed. By this means, the procedure according to the invention may be further improved especially in relation to the optimizing of the level of hotmelt adhesive material employed, in conjunction with a reduction in the number of application or coating steps.

In this context, moreover, it is possible in accordance with the invention to adopt a procedure wherein after the application of the hotmelt adhesive, especially the hotmelt adhesive melt, to the surface, especially flat side surface, and/or after step b), especially after step b1) and/or after step b2), preferably after step b2), there is optional further, preferably automated, capture and evaluation, especially optical capture and evaluation, preferably opto-electronic capture and evaluation, of the surface filled or coated with the hotmelt adhesive, especially flat side surface, preferably of the unevennesses, indentations, cavities, holes and/or craters filled and/or coated with the hotmelt adhesive. One particular possible procedure here in accordance with the invention is that wherein subsequently, in the event of incomplete and/or inadequate filling-in and/or coating, there is a further application of the hotmelt adhesive, especially the hotmelt adhesive melt. Moreover, after the application of the hotmelt adhesive, especially the hotmelt adhesive melt, to the surface, especially flat side surface, and/or after step b), especially after step b1) and/or after step b2), preferably after step b2), there may be smoothing and/or standardization of the applied hotmelt adhesive, especially the hotmelt adhesive filling or hotmelt adhesive layer, preferably the hotmelt adhesive layer. For this purpose it is possible for example to make use, in particular, of heatable smoothing rolls or the like. The smoothing roll may be operated, for example, in contra-rotation to the transport direction or advance direction of the oriented strand board. This smoothing may be carried out in the not (fully) cooled and/or not (fully) consolidated state of the applied hotmelt adhesive. In particular, the thermoplastic behaviour of the hotmelt adhesive employed may be utilized correspondingly in the context of the smoothing, even in the case of reactive hotmelt adhesives which are not (fully) crosslinked.

In the context of the present invention, after the application of the hotmelt adhesive, especially the hotmelt adhesive melt, to the surface, especially flat side surface, and/or after step b), especially after step b1) and/or after step b2), preferably after step b2), there may be structuring and/or profiling, especially surface structuring and/or surface profiling, of the applied hotmelt adhesive, especially the hotmelt adhesive filling and/or the hotmelt adhesive layer, preferably the hotmelt adhesive layer. In this case the structuring and/or profiling may be carried out by means of a preferably heatable structuring and/or profiling roll, but also by means of corresponding metal structuring and/or profiling plates, structuring and/or profiling papers, and also combinations thereof. With regard also to the optional structuring and/or profiling to be carried out, it is possible preferably to work in the not (fully) cooled and/or not (fully) consolidated state of the hotmelt adhesive employed. By virtue of the structuring and/or profiling it is possible for the treated surface or the applied hotmelt adhesive to be equipped with additional optical and/or decorative properties and also with further functional properties, such as an anti-skid or anti-slip function.

In this connection, the smoothing on the one hand and/or the structuring and/or profiling on the other hand may be carried out during the cooling and/or consolidating and/or before and/or after the cooling and consolidating of the hotmelt adhesive and/or before, during and/or after step c), in particular before the cooling and consolidating of the hotmelt adhesive and/or before step c). In particular, where the hotmelt adhesive employed in accordance with the invention also has thermoplastic properties after the cooling and/or after the consolidating, it is possible for the smoothing and/or structuring and/or profiling to be carried out in particular with heating, in principle, even after the cooling and/or curing of the hotmelt adhesive.

Furthermore, provision may be made in the context of the present invention, after the application of the hotmelt adhesive, especially the hotmelt adhesive melt, to the surface, especially flat side surface, and/or after step b), and/or after the smoothing and/or standardization and/or after the structuring and/or profiling, moreover, for enhancement and/or further coating of the surface, especially flat side surface, to be carried out.

In this context, the surface enhancement may be accomplished by (i) coating, especially with resin films and/or resin layers, preferably condensation resin films and/or layers, more preferably melamine resin films and/or layers and/or phenolic resin films and/or layers; (ii) lining, especially adhesive-lining; (iii) surface coating; and/or (iv) laminating. In general it is possible, accordingly, for the oriented strand board provided in the context of the present invention to be subjected to further surface treatment in the form of enhancement, such as, for example, by surface-coating and/or lining of the surface with, in particular, substrates and/or materials in layer form. In this context, the oriented strand board may be equipped with further decorative and/or functional properties. Applied to the previously treated oriented strand boards, for example, there may among others be veneers, foils HPL (High Pressure Laminate) materials, CPL (Continuous Pressed Laminate) materials, condensation resin films, wallpapers, textiles, mineral-based and/or synthetic resin-based renders or the like. Furnishing with the materials in question, an operation which takes place in particular by lining, preferably adhesive lining, may be accomplished, for example, via roll application or nozzle application (wide-slot nozzle, spray application or multi-bead application), depending on the material employed.

In general, the further surface enhancement may be carried out during the cooling and consolidating and/or before and/or after the cooling and consolidating of the hotmelt adhesive and/or before, during and/or after step c), especially after the cooling and the consolidating of the hotmelt adhesive and/or after step c).

The method of the invention may be carried out continuously and/or automatedly, especially continuously. The method according to the invention may especially be carried out continuously in relation to the sequence of the respective method steps.

In accordance with the invention it will be immediately appreciated that the selection and embodiment and also the nature of the application and/or the applying of the hotmelt adhesive, especially the hotmelt adhesive melt, in the individual method steps or method sections, in particular in relation to the formation of the hotmelt adhesive filling on the one hand and of the hotmelt adhesive layer on the other hand, may in each case take place independently of one another. In particular it will immediately be appreciated in accordance with the invention that the selection and embodiment and also the nature of the application and/or applying of the hotmelt adhesive, especially the hotmelt adhesive melt, (i) for the filling and/or filling-in of the unevennesses, indentations, cavities, holes and/or craters and/or for the formation of the hotmelt adhesive filling and/or in step b1) on the one hand, and (ii) for the coating and/or filming of the surface, preferably flat side surface, and/or for the formation of the hotmelt adhesive layer and/or in step b2), on the other hand, may in each case take place independently of one another.

With regard in general to the oriented strand boards used in accordance with the invention, they are distinguished in particular by the following properties:

The oriented strand board generally has a density, especially bulk density, in the range from 300 kg/m$^3$ to 1000 kg/m$^3$, especially in the range from 400 kg/m$^3$ to 900 kg/m$^3$, preferably in the range from 500 kg/m$^3$ to 800 kg/m$^3$, more preferably in the range from 550 kg/m$^3$ to 750 kg/m$^3$.

Moreover, the oriented strand board may have a multiplicity of chips in particular in layer-wise arrangement and/or oriented, especially wood chips, preferably in the form of chip strands.

In this connection, the chips may have a length, especially average length, in the range from 50 mm to 400 mm, especially in the range from 75 mm to 300 mm, preferably in the range from 100 mm to 200 mm.

The chips may likewise have a width, especially average width, in the range from 2 mm to 100 mm, especially in the range from 5 mm to 75 mm, preferably in the range from 10 mm to 50 mm.

The chips, moreover, may have a thickness, especially average thickness, in the range from 0.2 mm to 5 mm, especially in the range from 0.4 mm to 3 mm, preferably in the range from 0.6 mm to 1.5 mm.

Lastly, the chips may be assembled using at least one binder and/or pressed in order to form an assembly.

As noted above, the oriented strand boards in question, including in particular in the region of their surface, have a multiplicity of unevennesses, indentations, cavities, holes and/or craters, which in the context of the method of the invention can be filled in effectively, in tandem in particular with effective coating of the oriented strand boards, on the basis of a specific hotmelt adhesive, as recited above. Overall, therefore, on the basis of the present invention, a high-performance method which is economic over all is provided for the treatment, especially levelling, of the surface, especially flat side surface, of oriented strand boards, this method being accompanied by the abovementioned advantages and properties.

A further subject of the present invention—according to a second aspect of the invention—is, moreover, the oriented strand board (OSB wood composite board) having at least one treated, especially leveled, surface, preferably flat side surface, the oriented strand board being obtained and/or obtainable by the above-described method according to the invention.

In this connection, therefore, the present invention also relates to the oriented strand board (OSB wood composite board) as such, having at least one treated, especially leveled, surface, preferably flat side surface, where the surface, especially flat side surface, has a multiplicity of unevennesses, indentations, cavities, holes and/or craters, and the unevennesses, indentations, cavities, holes and/or craters are filled or filled in with at least one hotmelt adhesive, especially such that there is homogenization and/or levelling of the surface, preferably the flat side surface.

With regard to the oriented strand board of the invention in this context, provision may be made in accordance with the invention for the hotmelt adhesive, especially the hotmelt adhesive melt, to be applied such that the unevennesses, indentations, cavities, holes and/or craters are filled or filled in with the hotmelt adhesive, especially so as to form a hotmelt adhesive filling, especially hotmelt adhesive levelling filling.

In particular, the oriented strand board according to the invention may have at least one hotmelt adhesive filling, especially hotmelt adhesive levelling filling, arranged on the surface, especially flat side surface. In this connection, the hotmelt adhesive filling may be designed such that the unevennesses, indentations, cavities, holes and/or craters are filled and/or filled in with the hotmelt adhesive.

In the context of the present invention, the situation in this context is especially that the unevennesses, indentations, cavities, holes and/or craters are filled or filled in at least substantially completely with the hotmelt adhesive.

In particular, provision may be made, in accordance with the invention, for the unevennesses, indentations, cavities, holes and/or craters to be filled or filled in to an extent of at least 30%, especially at least 50%, preferably at least 70%, more preferably at least 80%, very preferably at least 90%, very preferably at least 95% and especially preferably at least 98%, based on the volume of the unevennesses, indentations, cavities, holes and/or craters, with the hotmelt adhesive.

Provision may likewise be made in this context for the hotmelt adhesive filling to be interspersed at least partially and/or sectionally with strands delimiting or forming the unevennesses, indentations, cavities, holes and/or craters, and/or optionally interrupted by them. Moreover, the strands delimiting or forming the unevennesses, indentations, cavities, holes and/or craters may project at least partially and/or sectionally into the hotmelt adhesive filling.

In general, in this context, the hotmelt adhesive filling may have a thickness in the range from 0.2 mm to 50 mm, especially in the range from 0.5 mm to 25 mm, preferably in the range from 1 mm to 10 mm, more preferably in the range from 1 mm to 5 mm.

Furthermore, provision may be made in accordance with the invention for the hotmelt adhesive, especially the hotmelt adhesive melt, to be applied, moreover, such that the surface, especially flat side surface, and/or the hotmelt adhesive filling is coated and/or filmed at least partially and/or sectionally, preferably over the full area, with the hotmelt adhesive, especially with the hotmelt adhesive melt.

With further regard to the oriented strand board of the invention, it may therefore comprise at least one hotmelt adhesive layer, especially hotmelt adhesive capping layer, applied to or arranged on the surface, especially flat side surface, and/or on the hotmelt adhesive filling. In this connection, the design of the hotmelt adhesive layer may be such that the surface, especially flat side surface, and/or the hotmelt adhesive filling are/is coated and/or filmed at least partially and/or sectionally, preferably over the full area, with the hotmelt adhesive, especially with the hotmelt adhesive melt. In this case the hotmelt adhesive layer may be at least substantially closed or at least substantially uninterrupted in design. Moreover, provision may be made for the hotmelt adhesive layer to comprise at least substantially no strands delimiting or forming the unevennesses, indentations, cavities, holes and/or craters.

In this connection, the hotmelt adhesive layer may have a thickness in the range from 0.1 mm to 30 mm, especially in the range from 0.2 mm to 20 mm, preferably in the range from 0.5 mm to 10 mm, more preferably in the range from 0.75 mm to 5 mm, very preferably in the range from 1 mm to 3 mm.

Especially in this context, the hotmelt adhesive, especially the hotmelt adhesive melt, may be applied in an amount in the range from 10 g/m$^2$ to 2000 g/m$^2$, especially in the range from 25 g/m$^2$ to 1500 g/m$^2$, preferably in the range from 50 g/m$^2$ to 1000 g/m$^2$, more preferably in the range from 75 g/m$^2$ to 800 g/m$^2$, very preferably in the range from 100 g/m$^2$ to 600 g/m$^2$, based on the surface, especially flat side surface.

In general, provision may also be made in accordance with the invention for the hotmelt adhesive filling on the one hand and the hotmelt adhesive layer, especially hotmelt adhesive capping layer, on the other hand to be present, so to speak, as a unitary layer, more particularly in the form of a filling and/or capping layer, something which may be accomplished, for example, by application of the hotmelt adhesive over all in a single application step to the surface, especially flat side surface.

In accordance with the invention, with regard to the properties of the oriented strand board of the invention, particularly good results are obtained if the hotmelt adhesive is a thermoplastic and/or one-component hotmelt adhesive, especially a one-component hotmelt adhesive.

In this connection, the hotmelt adhesive ought to be at least substantially water-free and/or solvent-free. In this connection, the hotmelt adhesive ought to have a water content and/or solvent content of at most 10 wt. %, especially at most 5 wt. %, preferably at most 2 wt. %, more preferably at most 1 wt. %, very preferably at most 0.5 wt. %, especially preferably at most 0.1 wt. %, based on the hotmelt adhesive.

In the context of the present invention, it is especially preferred if the hotmelt adhesive is a reactive hotmelt adhesive, especially a thermoplastic and/or one-component reactive hotmelt adhesive, preferably a one-component reactive hotmelt adhesive.

In this connection it is also advantageous if the reactive hotmelt adhesive is a moisture-crosslinking, heat-crosslinking and/or radiation-crosslinking hotmelt adhesive, especially a moisture-crosslinking and/or radiation-crosslinking, preferably a moisture-crosslinking hotmelt adhesive.

According to one embodiment less preferred in accordance with the invention, provision may also be made for the hotmelt adhesive to be a non-reactive hotmelt adhesive, especially a thermoplastic and/or one-component non-reactive hotmelt adhesive, preferably a one-component non-reactive hotmelt adhesive.

Equally it is possible in the context of the present invention to use a hotmelt adhesive based on natural raw materials, especially polylactic acid (PLA).

In accordance with the invention, provision may also be made for the hotmelt adhesive to have at least one adhesion promoter and/or primer. In this context, the adhesion promoter may be selected from the group consisting of silicon oxides, silanes, silicas, siliceous earths and also mixtures and combinations thereof.

The hotmelt adhesive may also comprise at least one additive. In this connection, the additive may be selected from the group consisting of plasticizers, high-boiling organic oils, esters or other additives serving for plasticization, stabilizers, especially UV stabilizers, antioxidants, acid scavengers, especially nanoparticulate fillers, ageing inhibitors and mixtures or combinations thereof.

The hotmelt adhesive may further comprise at least one non-reactive polymer, resin and/or wax, especially a natural, synthetic or chemically modified (semi-synthetic) wax.

Moreover, the hotmelt adhesive may comprise at least one functionalizing component. In this connection, the functionalizing component may be selected from the group consisting of electrically conductive substances, anti-microbial, anti-mycotic and/or fungicidal substances and also mixtures and combinations thereof.

Furthermore, the hotmelt adhesive may comprise at least one dye and/or at least one colour pigment. In this connection, the dye or the colour pigment may be selected from the group of organic pigment dyes, inorganic pigment dyes and also mixtures and combinations thereof.

The oriented strand board of the invention may further be of a design in which the surface, especially flat side surface, is smoothed, especially abraded. In this connection, the unevennesses, indentations, cavities, holes and/or craters may in particular have been reduced in size and/or homogenized by ablation preferably of strand material. Consequently, the amount of hotmelt adhesive applied per unit area may be reduced accordingly.

Furthermore, the design of the oriented strand board of the invention may be such that the hotmelt adhesive applied to the surface, especially flat side surface, especially the hotmelt adhesive filling and/or the hotmelt adhesive layer, is smoothed or standardized. By this means, the surface properties may be further improved, particularly in respect of a uniform and homogeneous appearance on the part of the oriented strand board of the invention.

Conversely, in the context of the present invention, provision may also be made for the hotmelt adhesive, applied to the surface, especially flat side surface, especially the hotmelt adhesive filling and/or the hotmelt adhesive layer, to be structured and/or profiled. By this means it is possible to provide further decorative properties. Moreover, on the basis of the structuring and/or profiling of the surface, it is possible for the anti-slip properties to be improved and therefore the skid resistance to be increased accordingly.

Provision may be made in accordance with the invention, moreover, for the oriented strand board, especially on the surface, especially flat side surface, preferably on the hotmelt adhesive, especially on the hotmelt adhesive filing and/or the hotmelt adhesive layer, to be surface-enhanced and/or to have a further coating.

For example, the oriented strand board, especially on the surface, especially flat side surface, may have (i) at least one coating, especially with resin films and/or resin layers, preferably condensation resin films and/or layers, more preferably melamine resin films and/or layers and/or phenolic resin films and/or layers; (ii) at least one lining, especially adhesive-lining; (iii) at least one surface coating; and/or (v) at least one lamination.

With further regard to the oriented strand board present in accordance with the invention, it may have a density, especially bulk density, in the range from 300 kg/m$^3$ to 1000 kg/m$^3$, especially in the range from 400 kg/m$^3$ to 900 kg/m$^3$, preferably in the range from 500 kg/m$^3$ to 800 kg/m$^3$, more preferably in the range from 550 kg/m$^3$ to 750 kg/m$^3$.

The oriented strand board according to the invention is notable, moreover, in that it has a multiplicity of chips, especially wood chips, preferably in the form of chip strands, which are in particular arranged layerwise and/or are oriented.

In this connection, the chips may have a length, especially average length, in the range from 50 mm to 400 mm, especially in the range from 75 mm to 300 mm, preferably in the range from 100 mm to 200 mm.

Moreover, the chips may have a width, especially average width, in the range from 2 mm to 100 mm, especially in the range from 5 mm to 75 mm, preferably in the range from 10 mm to 50 mm.

Furthermore, the chips may have a thickness, especially average thickness, in the range from 0.2 mm to 5 mm, especially in the range from 0.4 mm to 3 mm, preferably in the range from 0.6 mm to 1.5 mm.

In relation to the oriented strand board of the invention and/or to the original board or base board employed in this regard, it is the case in particular that the chips are assembled by means of at least one binder and/or are pressed so as to form an assembly.

As recited above, the oriented strand board of the invention is notable for improved (surface) properties, especially with regard to improved weathering, UV and/or moisture resistance. Moreover, the oriented strand boards of the invention have high chemical resistance. By virtue of the at least substantially uninterrupted and/or complete coating of the surface, especially flat side surface, the underlying constituents of the oriented strand board are effectively protected against weathering and/or environmental influences, such as moisture, in conjunction with a high mechanical stability on the part of the coating.

A further subject of the present invention, moreover, is—according to a third aspect of the invention—the production plant of the invention for treating, especially levelling, at least one surface, preferably at least one flat side surface, of oriented strand boards (OSB wood composite boards), wherein the surface, especially flat side surface, has a multiplicity of unevennesses, indentations, cavities, holes and/or craters, and/or for implementing the method of the invention, as described above, wherein the production plant comprises the following units:

(A) optionally at least one abrading means, especially calibration-abrading means, especially for abrading, preferably calibration-abrading, the at least one surface, especially flat side surface, of the oriented strand board;

(B) optionally at least one heating and/or temperature-conditioning means, more particularly for heating and/or for temperature conditioning of the oriented strand board, preferably of the at least one surface, especially flat side surface, of the oriented strand board, especially wherein the heating and/or temperature-conditioning means is disposed downstream of the abrading means;

(C) at least one filling-in and/or coating means, especially for applying at least one hotmelt adhesive, especially in the form of a hotmelt adhesive melt, to the at least one surface, especially flat side surface, of the oriented strand board such that at least the unevennesses, indentations, cavities, holes and/or craters are filled and/or filled in at least substantially with the hotmelt adhesive, especially the hotmelt adhesive melt, especially such that a homogenization and/or levelling of the surface, preferably the flat side surface, especially so as to form at least one hotmelt adhesive filling, is brought about, and optionally for further applying the hotmelt adhesive, especially in the form of the hotmelt adhesive melt, to the at least one surface, especially flat side surface, of the oriented strand board and/or to the hotmelt adhesive filling such that the surface, especially flat side surface, and/or the hotmelt adhesive filling is coated and/or filmed at least partially and/or sectionally, preferably over the full area, with the hotmelt adhesive, especially with the hotmelt adhesive melt, especially wherein there results at least one hotmelt adhesive layer, especially hotmelt adhesive capping layer, disposed on the surface, especially flat side surface, and/or on the hotmelt adhesive filling, especially wherein the filling-in and/or coating means is disposed downstream of the heating and/or temperature-conditioning means;

(D) optionally at least one surface-treating and/or structuring means, especially for the smoothing and/or for the structuring and/or profiling of the applied hotmelt adhesive, especially the hotmelt adhesive filling and/or the hotmelt adhesive capping layer, preferably the hotmelt adhesive capping layer, especially wherein the surface-treating and/or structuring means is disposed downstream of the filling-in and/or coating means;

(E) optionally at least one cooling means, especially for cooling and consolidating, especially curing and/or solidifying, the applied hotmelt adhesive, especially the hotmelt adhesive melt, especially wherein the cooling means is disposed downstream of the filling-in and/or coating means and/or downstream of the surface-treating and/or structuring means.

The production plant of the invention may in particular comprise a plurality, especially two, three, four or more, of filling-in and/or coating means. In this context, the respective filling-in and/or coating means may in particular be arranged downstream of one another or in series. On this basis, multiple or consecutive application of the hotmelt adhesive to the surface, especially flat side surface, with a hotmelt adhesive application rate increasing in the course of the method, is possible, and so in this way the corresponding hotmelt adhesive filling or hotmelt adhesive layer can be formed progressively.

Equally, however, it is also possible in the context of the present invention for the production plant according to the invention to have at least one return means, especially for the return transport or return push of the oriented strand board especially to the filling-in and/or coating means. Through this arrangement, it is possible in the context of the production plant of the invention for the oriented strand board to be able to be passed again through a corresponding filling-in and/or coating means for further application of the hotmelt adhesive. As a result of this, the number of filling-in and/or coating means can be reduced accordingly. The return means may in particular be a constituent of the transport and/or advance means, which is described hereinafter.

With regard to the abrading means of the production plant of the invention, said means may have at least one agent for abrading, especially an abrading roll. In particular, moreover, the abrading means may have at least one agent for cleaning and/or for removing abraded material. This agent may comprise, for example, a brush roll and/or a suction removal device or the like.

Furthermore, the heating and/or temperature-conditioning means on which the production plant according to the invention is based may have at least one agent for heating and/or for temperature-conditioning the oriented strand board, preferably the surface, especially flat side surface, of the oriented strand board, more particularly a radiant heater or convection heater or an oven, especially a belt oven or tunnel oven, and/or at least one agent for capturing and/or controlling the temperature of the oriented strand board, especially the surface, preferably flat side surface, of the oriented strand board.

Through the heating of the oriented strand board prior to application of the hotmelt adhesive, it is possible to improve the application behaviour overall, especially in respect of an at least substantially complete filling or filling-in of the unevenesses, indentations, cavities, holes and/or craters in question, particularly since premature cooling and/or consolidating of the hotmelt adhesive, of the kind that may be the case if it is applied to a cold or unheated substrate, is prevented.

Furthermore, the filling-in and/or coating means of the production plant according to the invention may have at least one agent for heating the hotmelt adhesive, preferably for maintaining the hotmelt adhesive melt, and/or at least one agent for applying the hotmelt adhesive, especially the hotmelt adhesive melt, to the surface, especially flat side surface.

In this connection, the agent for applying the hotmelt adhesive, especially the hotmelt adhesive melt, may be selected from the group consisting of (i) hotmelt adhesive rolls, especially hotmelt adhesive metering rolls and/or hotmelt adhesive applicator rolls; (ii) hotmelt adhesive applicator nozzles, especially hotmelt adhesive slot nozzles, preferably hotmelt adhesive wide-slot nozzles; (iii) hotmelt adhesive doctor blades, especially hotmelt adhesive roll doctor blades; particularly preferably (i) rolls, especially hotmelt adhesive metering rolls and/or hotmelt adhesive applicator rolls, and combinations thereof.

In the context of the present invention, in this regard, it is possible in particular to use heatable hotmelt adhesive applicator rolls with separate, especially evenly heatable hotmelt adhesive metering rolls. Likewise, in accordance with the invention, it is possible for a hotmelt adhesive applicator roll in particular with doctor blade system to be used, especially for defined application of the required application quantity of hotmelt adhesive, preferably hotmelt adhesive melt.

In the context of the present invention, provision may be made for the agent for applying the hotmelt adhesive, especially the hotmelt adhesive roll, especially hotmelt adhesive metering roll and/or hotmelt adhesive applicator roll, to be of heatable design. By this means, premature cooling and/or consolidation of the hotmelt adhesive used is prevented, and the fluidity of the hotmelt adhesive on application to the surface, especially flat side surface, is maintained, which further improves the quality of application.

Furthermore, provision may be made in accordance with the invention for the filling-in and/or coating means to have B1) at least one first agent for applying the hotmelt adhesive, especially the hotmelt adhesive melt, to the surface, especially flat side surface, such that the unevenesses, indentations, cavities, holes and/or craters are filled and/or filled in with the hotmelt adhesive, especially so as to form a hotmelt adhesive filling, preferably hotmelt adhesive levelling filling; and/or B2) at least one second agent for applying the hotmelt adhesive, especially the hotmelt adhesive melt, to the surface, especially flat side surface, of the oriented strand board and/or to the hotmelt adhesive filling, such that the surface, especially flat side surface, and/or the hotmelt adhesive filling is coated and/or filmed, moreover, at least partially and/or sectionally, preferably over the full area, with the hotmelt adhesive, especially with the hotmelt adhesive melt, especially wherein at least one hotmelt adhesive layer, especially hotmelt adhesive capping layer, disposed on the surface, especially flat side surface, and/or on the hotmelt adhesive filling, is obtained as a result.

In this context, provision may fundamentally be made in accordance with the invention for the filling-in and/or coating means to have a plurality of first agents and a plurality of second agents for applying the hotmelt adhesive.

It is preferred in accordance with the invention if the agent for applying the hotmelt adhesive is designed in the form of, or comprises, a hotmelt adhesive roll, especially hotmelt adhesive metering roll and/or hotmelt adhesive applicator roll, in which case the hotmelt adhesive roll, especially the hotmelt adhesive metering roll and/or the hotmelt adhesive applicator roll, can be operated in co-rotation or counter-rotation to the transport direction and/or advance direction of the oriented strand board. In this connection, it is likewise preferred in accordance with the invention if the hotmelt adhesive roll, especially the hotmelt adhesive metering roll and/or the hotmelt adhesive applicator roll, has at least one means for controlling and/or for operating the hotmelt adhesive roll, especially the hotmelt adhesive metering roll and/or the hotmelt adhesive applicator roll, in co-rotation or counter-rotation to the transport direction and/or advance direction of the oriented strand board. In this way it is possible in particular to correspondingly adjust or dictate the amount of the hotmelt adhesive that is applied.

Equally, provision may be made in accordance with the invention for the production plant and/or the filling-in and/or coating means, especially the agent for applying the hotmelt adhesive, to have at least one control means for adjusting and/or for controlling the amount of hotmelt adhesive applied. The control means for adjusting and/or for controlling the amount of hotmelt adhesive applied may be designed such, for example, that the amount of hotmelt adhesive to be applied can be adjusted as a function of the transport speed and/or advance speed of the oriented strand board. In this way, a uniform and defined application of adhesive is ensured in conjunction with high throughput.

In particular, in the context of the present invention, provision may also be made for the agent for applying the hotmelt adhesive to be formed as or to comprise a hotmelt adhesive roll, especially hotmelt adhesive metering roll and/or hotmelt adhesive applicator roll, in which case the hotmelt adhesive roll, especially the hotmelt adhesive metering roll and/or the hotmelt adhesive applicator roll, has at least one control means for adjusting and/or for controlling the rotational roll speed and/or the peripheral roll speed, more particularly as a function of the transport speed and/or advance speed of the oriented strand board.

The production plant according to the invention may likewise have at least one transport and/or advance means especially for transporting and/or advancing the oriented strand board. In this connection, the transport and/or advance means may have at least one control means for adjusting and/or for controlling the transport and/or advance speed of the oriented strand board. In this respect, the control means for adjusting and/or for controlling the transport and/or advance speed may be designed such that the transport and/or advance speed of the oriented strand board can be adjusted depending on the amount of hotmelt adhesive to be applied and/or depending on the rotational roll speed and/or the peripheral roll speed of the hotmelt adhesive metering roll and/or of the hotmelt adhesive applicator roll.

Through the setting of the transport and/or advance speed of the oriented strand board, especially in harmony with the setting of the turning or rotation direction and/or the rotational or peripheral speed of the hotmelt adhesive rolls used in accordance with the invention, especially hotmelt adhesive metering roll and/or hotmelt adhesive applicator roll, it is possible overall to dictate the amount of hotmelt adhesive to be applied.

In accordance with the invention, furthermore, provision may be made for the production plant according to the invention to have at least one capture and/or evaluation means for the preferably automated capture and evaluation, especially optical capture and evaluation, preferably opto-electronic capture and evaluation, of the surface, especially flat side surface, preferably of the unevennesses, indentations, cavities, holes and/or craters. In this regard, the capture and/or evaluation means may be arranged downstream of the abrading means and/or downstream of the heating and/or temperature-conditioning means and/or upstream of the filling-in and/or coating means. In this connection, the production plant according to the invention, moreover, may have at least one agent for controlling the amount of hotmelt adhesive to be applied or to be delivered as a function of the optical capture and evaluation of the surface, especially flat side surface, of the oriented strand board. In this connection, therefore, a hotmelt adhesive application rate can be set that is adapted to the particular circumstances, being more particularly site-specific, and this leads to correspondingly optimized coatings in conjunction with a saving in terms of material.

Furthermore, provision may be made for the production plant according to the invention to have at least one, optionally further, capture and/or evaluation means for the preferably automated capture and evaluation, especially optical capture and evaluation, preferably opto-electronic capture and evaluation, of the filling and/or coating of the surface, especially flat side surface, preferably of the filling and/or coating of the unevennesses, indentations, cavities, holes and/or craters, with the hotmelt adhesive. In this regard, the further capture and/or evaluation means may be arranged downstream of the filling-in and/or coating means. In this regard, for example, the production plant may be designed in such a way that if it is not completely coated or the like, the oriented strand board is subjected to a further application of hotmelt adhesive, by means, for example, of being re-supplied to the filling-in and/or coating means, in particular by the transport and/or advance means and/or the return means.

On this basis, the production plant of the invention allows a continuous and/or automated or fully automatic treatment of the OSB boards in question.

Moreover, the surface-treating and/or structuring means may have at least one agent for smoothing and/or standardizing the applied hotmelt adhesive, especially a preferably heatable smoothing roll, and/or at least one agent for structuring and/or profiling the applied hotmelt adhesive, especially selected from the group consisting of preferably heatable structuring and/or profiling rolls, structuring and/or profiling plates, structuring and/or profiling papers, and also combinations thereof.

Furthermore, the production plant according to the invention may comprise, moreover, at least one coating, lining, surface-coating and/or laminating means. This coating, lining, surface-coating and/or laminating means may be arranged downstream of the filling-in and/or coating means or upstream of the cooling means or else downstream of the cooling means. On this basis, it is possible to undertake further enhancement of the surface, by application, for example, of (decorative) foils, paint systems or the like.

On the basis of the production plant according to the invention, it is possible as a result, in an efficient way, to treat oriented strand boards, especially on the basis of the method according to the invention, on their surface, especially flat side surface, with a hotmelt adhesive for the purpose of sealing the relevant wood-based material boards.

A subject of the present invention—according to a fourth aspect of the invention—is, moreover, the use of at least one hotmelt adhesive, especially as defined above, for increasing the weathering, UV and/or moisture resistance of an oriented strand board (OSB wood composite board) and/or for furnishing an oriented strand board (OSB wood composite board) with applications properties for the exterior sector.

In this connection, moreover, another subject of the present invention—according to a fifth aspect of the invention—is the use of at least one hotmelt adhesive, especially as defined above, for homogenizing and/or levelling the surface, preferably the flat side surface, of an oriented strand board.

As noted above, the relevant hotmelt adhesive, as used in the context of the uses according to the fourth and fifth aspects of the invention, is with preference in accordance with the invention a one-component hotmelt adhesive and/or a reactive hotmelt adhesive, especially a one-component reactive hotmelt adhesive.

With further regard to the uses according to the fourth and fifth aspects of the invention, the hotmelt adhesive, especially in the form of a hotmelt adhesive melt, may be applied to at least one surface, especially flat side surface, of the oriented strand board such that at least the unevennesses, indentations, cavities, holes and/or craters are filled and/or filled in at least substantially with the hotmelt adhesive, especially the hotmelt adhesive melt, especially wherein there is homogenization and/or levelling of the surface, preferably the flat side surface, especially with formation of at least one hotmelt adhesive filling.

Equally, provision may be made, in the context of the present uses, for the hotmelt adhesive, especially the hotmelt adhesive melt, to be applied, moreover, such that the surface, especially flat side surface, and/or the hotmelt adhesive filling are or is coated and/or filmed at least partially and/or sectionally, preferably over the full area, with the hotmelt adhesive, especially with the hotmelt adhesive melt, especially where a result is at least one hotmelt adhesive layer, especially hotmelt adhesive capping layer, arranged on the surface, especially flat side surface, and/or on the hotmelt adhesive filling.

Yet a further subject of the present invention—according to a sixth aspect of the invention—is, moreover, the use of at least one oriented strand board, as defined above, for the various applications recited below.

Thus the oriented strand board of the invention, as defined above, is suitable for use as and/or for producing especially weathering-, UV- and/or moisture-resistant and/or decorative paneling, facings, façade elements, façade panels, construction elements and/or construction boards, preferably in the area of wall, roof and/or floor constructions, especially in the (construction) exterior sector and/or (construction) interior sector, preferably in the area of exterior and/or interior fitment.

Furthermore, the oriented strand board of the invention, as defined above, is suitable for use as and/or for producing furniture and/or furniture elements and/or especially decorative furniture panels, construction elements, construction boards, especially in furniture, shop and/or trade fair construction, preferably in the area of wall, roof and/or floor constructions. Moreover, the oriented strand board of the invention, as defined above, is suitable for use as and/or for producing especially weathering-, UV- and/or moisture-resistant packaging and/or transport elements and/or panels, packaging and/or transport devices, especially packaging and/or transport containers and/or crates, especially in the transport and/or packaging sector.

Lastly, the present invention—according to a seventh aspect of the invention—relates to the construction element and/or façade element of the invention, especially construction panel and/or façade panel, especially having weathering-, UV- and/or moisture-resistant and/or decorative properties, wherein the construction and/or façade element comprises or consists of at least one oriented strand board (OSB wood composite board) having at least one surface, preferably flat side surface, treated, especially leveled, with at least one hotmelt adhesive, especially oriented strand board (OSB wood composite board) as defined above.

The present invention is elucidated in more detail below, using figure representations and/or drawings which represent preferred exemplary embodiments. In connection with the elucidation of these preferred exemplary embodiments of the present invention, which, however, have no restrictive effect at all on the present invention, there are also descriptions of further advantages, properties and aspects and features of the present invention.

FIG. 1 therefore shows, in the form of a flow diagram, the implementation of the method of the invention for the treatment, especially levelling, of at least one surface, preferably at least one flat side surface, of oriented strand boards or OSB wood composite boards in accordance with one inventive embodiment.

In the procedure according to the invention, first of all, according to step 1, at least one oriented strand board is provided, the oriented strand board having at least one surface, preferably at least one flat side surface, containing a multiplicity of unevennesses, indentations, cavities, holes and/or craters, caused in general by the shaping and arrangement of the strands on which the oriented strand board is based. In this regard, reference may also be made to the representation in FIG. 3A.

In the method of the invention, provision may optionally be made, according to step 2, for the surface, especially flat side surface, to be smoothed, especially abraded, preferably calibration-abraded, before the surface is filled in with the hotmelt adhesive. The depletion of the material which this entails makes it possible to achieve smoothing and/or reduction in size of the unevennesses, indentations, cavities, holes and/or craters on the surface, especially flat side surface, and this is beneficial in particular to the subsequent application of hotmelt adhesive, particularly as regards reducing the level of material employed.

Furthermore, in the method of the invention, a fundamentally possible procedure is such that according to step 3, especially after the providing and/or after the abrading of the oriented strand board and also before the applying of the hotmelt adhesive, the surface, especially flat side surface, and/or the oriented strand board as such is preheated. By this means it is possible to enhance the wetting and/or penetration characteristics of the hotmelt adhesive in the form of the hotmelt adhesive melt into the unevennesses, indentations, cavities, holes and/or craters affecting the surface.

In the method of the invention, moreover, according to steps 4 and 5, provision is made for the application of at least one hotmelt adhesive, especially in the form of a hotmelt adhesive melt, to the at least one surface, especially flat side surface, of the oriented strand board. The procedure here, in accordance with the invention, is that at least the unevennesses, indentations, cavities, holes and/or craters are filled or filled in at least substantially with the hotmelt adhesive or the hotmelt adhesive melt. The effect of this, in particular, is to homogenize and/or level the surface, preferably the flat side surface.

In this connection, the application of hotmelt adhesive, especially in the form of the hotmelt adhesive melt, as part of the method of the invention, may also be carried out such that first of all, according to step 4, the hotmelt adhesive, especially in the form of the hotmelt adhesive melt, is applied in such a way that the unevennesses, indentations, cavities, holes and/or craters are filled or filled in with the hotmelt adhesive, especially so as to form a hotmelt adhesive filling, preferably hotmelt adhesive levelling filling, in tandem in particular with a corresponding homogenization and/or levelling of the surface thus treated. In this regard, reference may also be made to the representation in FIG. 3B.

Furthermore, as part of the application of the hotmelt adhesive according to step 5, a procedure may be followed wherein subsequently the hotmelt adhesive, especially in the form of the hotmelt adhesive melt, is applied such that the surface, especially flat side surface, and/or the hot melt adhesive filling are or is coated and/or filmed, moreover, at least partially and/or sectionally, preferably over the full area, with the hotmelt adhesive, more particularly wherein on this basis the result may be a hotmelt adhesive layer arranged on the surface and/or on the hotmelt adhesive filling, more particularly in the form of a hotmelt adhesive capping layer. In this regard, reference may also be made to the representation in FIG. 3C.

Furthermore, according to step 6, after the application of the hotmelt adhesive, especially the hotmelt adhesive melt, there may be smoothing and/or structuring and/or profiling of the applied hotmelt adhesive, especially in the not (fully) cooled state and/or especially in the not (fully) consolidated state of the hotmelt adhesive.

In accordance with the method of the invention, moreover, according to step 7, there is optional cooling and consolidating, especially curing and/or solidifying, of the hotmelt adhesive. Where reactive hotmelt adhesives are used, as preferred in accordance with the invention, the cooling and consolidating also includes, in particular, a (post-)crosslinking of the hotmelt adhesive used.

Finally, a procedure in accordance with the invention may be adopted wherein according to step 8, in particular after the cooling and/or consolidating, there is a further surface enhancement of the OSB board furnished with the hotmelt adhesive, this enhancement being accomplished, for example, by coating, lining, surface-coating, laminating or the like.

Figure 2:
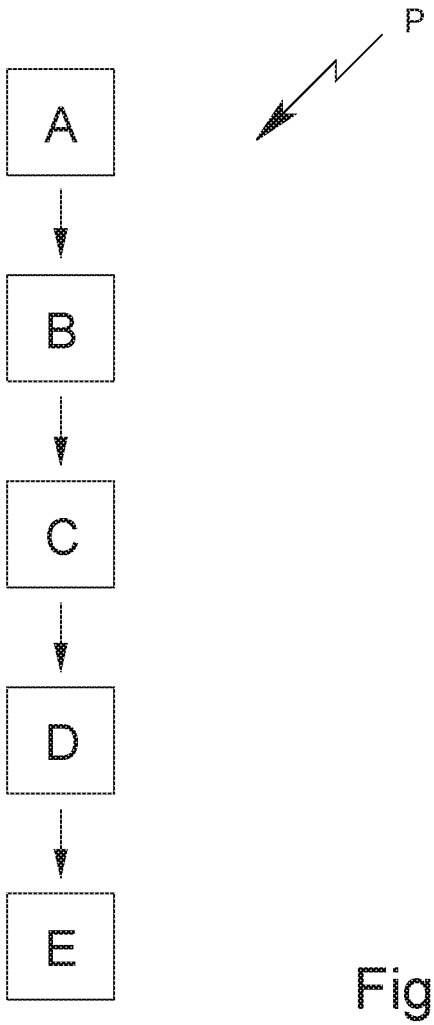
FIG. 2 shows a diagrammatic representation of a production plant according to the invention, in accordance with one inventive embodiment, for the treatment, especially levelling, of at least one surface, preferably at least one flat side surface, of oriented strand boards, or for implementing the method according to the present invention.

Furthermore, FIG. 2, in the form of a diagrammatic representation, shows a production plant P of the invention, and the production plant P according to the invention, in accordance with the inventive embodiment described, comprises at least one agent A in the form of an abrading means, especially for abrading, preferably calibration-abrading, the at least one surface, especially flat side surface, of the oriented strand board for treatment in accordance with the invention.

The production plant P according to the invention may, moreover, in accordance with agent B, optionally comprise at least one heating means and/or temperature-conditioning means, disposed in particular downstream relative to the abrading means.

Furthermore, the production plant P according to the invention may, in accordance with agent C, comprise at least one filling-in and/or coating means for application of the hotmelt adhesive, especially in the form of the hotmelt adhesive melt. In that case the filling-in and/or coating means in accordance with agent C may be disposed, in particular, downstream relative to the heating and/or temperature-conditioning means in accordance with agent B.

In accordance with the invention, moreover, provision may be made for the production plant P to comprise at least one surface treating and/or surface structuring means in accordance with agent D, and also, optionally, at least one cooling means in accordance with agent E, each of which may be arranged downstream relative to the filling-in and/or coating means.

Figure 3A:
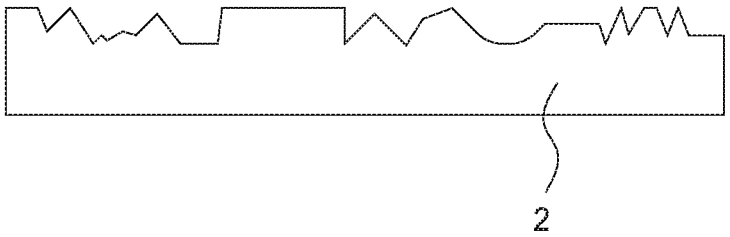
FIG. 3A shows a cross-sectional representation of an untreated oriented strand board (OSB wood composite board)

Furthermore, FIG. 3A shows an untreated original oriented strand board 2 having a corresponding flat side surface which includes a multiplicity of unevennesses, indentations, cavities, holes and/or craters which require filling.

Figure 3B:
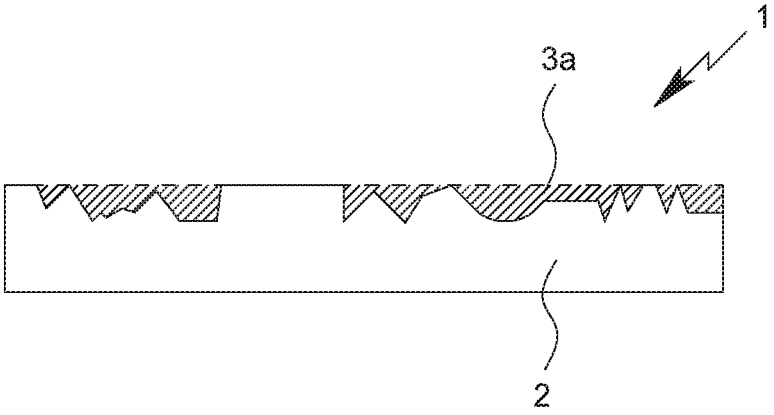
FIG. 3B shows a cross-sectional representation of an oriented strand board treated by the method of the invention, using a hotmelt adhesive, and with filled-in flat side surface, according to a first inventive embodiment.

Furthermore, FIG. 3B shows an oriented strand board 1 treated by the method of the invention, wherein the parent, original oriented strand board 2 has been filled in using a hotmelt adhesive on the flat side surface, especially so as to form a hotmelt adhesive filling 3*a*, in tandem with a corresponding homogenization and/or levelling of the flat side surface.

Figure 3C:
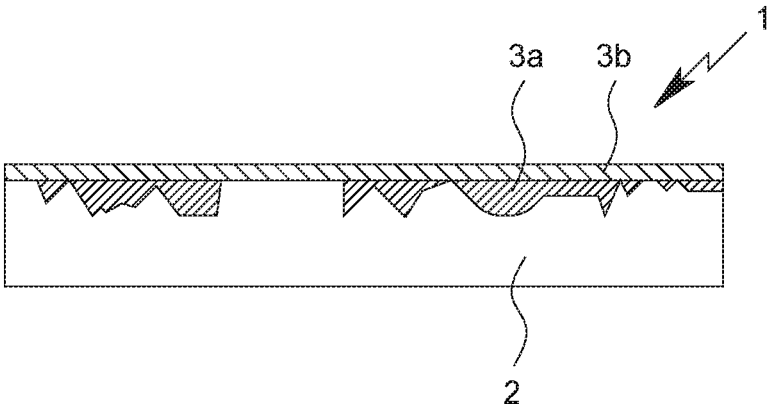
FIG. 3C shows a cross-sectional representation of an oriented strand board treated by the method of the invention, with correspondingly filled-in flat side surface and with further application of a hotmelt adhesive, especially for the formation of an additional hotmelt adhesive layer, according to a further inventive embodiment.

FIG. 3C shows an oriented strand board 1 treated by the method of the invention in accordance with a further inventive embodiment, whereby the treated oriented strand board 1 additionally has a further hotmelt adhesive layer 3*b*, applied to the flat side surface of the parent oriented strand board 2 and/or to the hotmelt adhesive filling 3*a*.

Figure 3D:
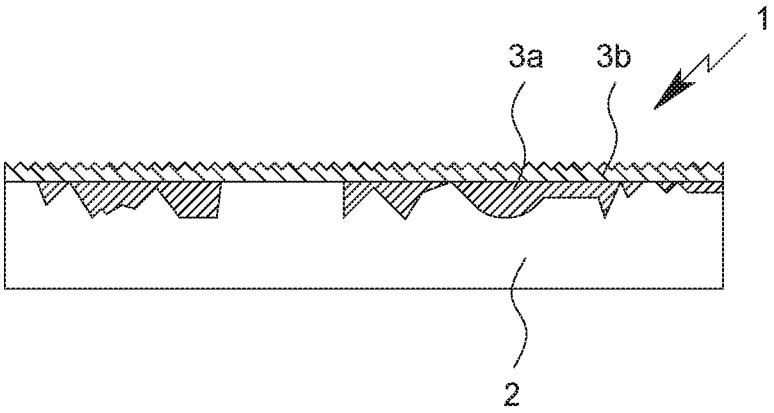
FIG. 3D shows a cross-sectional representation of an oriented strand board treated by the method of the invention, according to yet a further embodiment of the present invention, wherein the applied hotmelt adhesive layer is additionally structured and/or profiled.

Lastly, FIG. 3D shows a further oriented strand board 1 of the invention, in which, in addition to the embodiment of FIG. 3C, the additionally applied hotmelt adhesive layer 3*b* is profiled and/or structured.

Further refinements, modifications, variations, adaptations, features and advantages of the present invention are readily recognizable and realizable for the skilled person on a reading of the description, without that person departing from the realm of the present invention.

The present invention is illustrated, moreover, using the following Examples (i.e. exemplary embodiments), but without the present invention being confined to these embodiments.

EXAMPLES

Different oriented strand boards are produced, these being, firstly, oriented strand boards according to the present invention and secondly comparative oriented strand boards, each of the oriented strand boards being produced as described below:

For producing inventive oriented strand boards treated on their flat side surface, various hotmelt adhesive systems are respectively applied in the form of the respective hotmelt adhesive melt to a parent, untreated oriented strand board, using in this regard a corresponding production plant which comprises a filling-in and/or coating means based on hotmelt adhesive applicator rolls with doctor blade system. The hotmelt adhesive is applied at temperatures above the softening point and/or above the melting point of the hotmelt adhesive used, to the boards which have been preheated in each case, application taking place to an extent such that as well as complete filling of the unevennesses, indentations, cavities, holes and/or craters affecting the flat side surface, there is also complete coating in the form of a closed layer of hotmelt adhesive on the surface of the treated boards. The procedure adopted here is such that first of all, the hotmelt adhesive, in a first treatment step, is applied for filling in the aforesaid unevennesses, indentations, cavities, holes and/or craters, and subsequently, in a second method step, the respective hotmelt adhesive is applied again for forming the completely closed layer of hotmelt adhesive.

Subsequently, the applied hotmelt adhesive is in each case smoothed and the applied hotmelt adhesive is also cured and/or cooled, to give the finished oriented strand board in each case.

On this basis, oriented strand boards of the invention are produced using on the one hand in each case a reactive hotmelt adhesive in the form of PUR (inventive OSB board I), POR (inventive OSB board II) and, on the other hand, a non-reactive hotmelt adhesive in the form of EVA (inventive OSB board III).

Furthermore, corresponding, comparative oriented strand boards were produced, in which case for the treatment of the flat side surface and/or the filling of the unevennesses, indentations, cavities, holes and/or craters use is made on the one hand of a water-based coating system (comparative OSB board IV) and, on the other hand, of an organic solvent-based coating system (comparative OSB board V) for filling the unevennesses, indentations, cavities, holes and/or craters on the flat side of the respective oriented strand boards and for the subsequent application of a further, capping layer.

In contrast to the inventive OSB boards, using the reactive or non-reactive hotmelt adhesive, roll application is not possible, owing to the processing properties—not optimum in this regard—of both the water-based coating system and the coating system based on organic solvents. In relation to the comparative OSB boards IV and V, consequently, the particular coating system employed is applied to the flat side surface by manual trowelling for filling in the aforesaid unevennesses, indentations, cavities, holes and/or craters. It is followed by the application of the respective coating system to give a corresponding capping layer, for which purpose the respective coating system is applied by spraying to the flat side surface.

After cooling and/or consolidation and/or solidifying, the OSB boards thus provided are first of all evaluated visually for the optical quality of the treated flat side surface, particularly with regard to homogeneous formation of the applied layers, the evaluation taking place according to the school grade system (i.e. ratings from 1=very good to 6=inadequate).

The individual OSB boards are subsequently subjected, at the same time and under identical conditions, to an accelerated weathering test with defined exposure to moisture, wetness and temperature. This is followed by visual evaluation for the quality of the surface and/or the condition of the respective OSB board overall, particularly with regard to swelling of the OSB board, surface quality, cracking and/or delamination of the applied filling-in and/or coating systems; the evaluation here again takes place according to the school grade system.

The results of experimentation are summarized accordingly in the table below:

| OSB board | Optical properties/quality of the treated surface before weathering | Evaluation after weathering (one month) | Evaluation after weathering (three months) |
|---|---|---|---|
| OSB board 1 PUR, reactive (inventive) | 1 | 1 | 1 |
| OSB board II POR, reactive (inventive) | 1 | 1 | 2 |
| OSB board III EVA, non-reactive (inventive) | 1-2 | 3 | 3-4 |
| OSB board IV water-based coating system (comparative) | 2-3 | 4-5 | 6 |
| OSB board V coating system based on organic solvents (comparative) | 2-3 | 4 | 6 |

The results set out in the table show that the OSB boards of the invention overall have improved surface qualities, in relation to the optical properties as well; in the case of the OSB boards of the invention, a durable and uniform filling of the aforesaid unevennesses, indentations, cavities, holes and/or craters is ensured using mechanical methods. Furthermore, the OSB boards of the invention exhibit significantly improved weathering behaviour. On the basis of the present invention, therefore, all in all, oriented strand boards treated on their surface, especially flat side surface, are provided which while featuring substantial homogeneity and stability of the surface, also exhibit enhanced long-term resistance and weathering resistance.

The invention claimed is:

1. A method for levelling a flat side surface of an oriented strand board (OSB wood composite board), wherein the method comprises the following steps in the stated sequence:

a) providing the oriented strand board, wherein the oriented strand board comprises the flat side surface having a multiplicity of one of unevennesses, indentations, cavities, holes and craters; then b) applying at least two hotmelt adhesives, each in the form of a melt, to the flat side surface of the oriented strand board, wherein:

b1) first, an initial hotmelt adhesive melt is applied such that the unevennesses, indentations, cavities, holes or craters are filled at least substantially with the initial hotmelt adhesive, so as to form at least one hotmelt adhesive levelling filling, thus effecting homogenization and levelling of the flat side surface of the oriented strand board, and, b2) subsequently, a further hotmelt adhesive melt is applied such that the flat side surface of the oriented strand board is coated and filmed at least partially or sectionally with the further hotmelt adhesive melt, especially, thus resulting in at least one hotmelt adhesive layer top (capping) layer disposed on the flat side surface of the oriented strand board;

c) cooling and consolidating each hotmelt adhesive melt under curing and solidifying after implementation of each of steps b1) and b2) respectively, wherein step b1), on the one hand, and step b2), on the other hand, are carried out in separate steps, and wherein step b1 is carried out followed by cooling and consolidation of the initial hotmelt adhesive, and subsequently step b2 is carried out followed by cooling and consolidation of the further hotmelt adhesive.

2. The method according to claim 1, wherein the hotmelt adhesives are a thermoplastic or one-component hotmelt adhesives.

3. The method according to claim 1, wherein the hotmelt adhesives are at least substantially water-free and solvent-free, wherein the hotmelt adhesives have a water content and solvent content of at most 10 wt. %.

4. The method according to claim 1, wherein the hotmelt adhesives are reactive hotmelt adhesives.

5. The method according to claim 4, wherein the reactive hotmelt adhesives are selected among moisture-crosslinking, heat-crosslinking and radiation-crosslinking hotmelt adhesives.

6. The method according to claim 4, wherein the reactive hotmelt adhesives are selected among (i) reactive polyurethanes, (ii) reactive polyolefins; (iii) reactive poly(meth)acrylates; and also mixtures and combinations thereof.

7. The method according to claim 1, wherein the hotmelt adhesives have a softening point or softening range, determined according to DIN EN 1238:2011-07, in the range of from 30° C. to 200° C.

8. The method according to claim 1, wherein the hotmelt adhesives are applied by a least one of spraying application, nozzle application, slot nozzle application, coating application, knife coating application, roll application, printing process and extrusion application.

9. The method according to claim 1, wherein before the application of the hotmelt adhesives to the surface, a preheating of the flat side surface is carried out.

10. A method for increasing at least one of the weathering, UV and moisture resistance of an oriented strand board (OSB wood composite board), wherein the method comprises the following steps in the stated sequence:

a) providing the oriented strand board, wherein the oriented strand board comprises a flat side surface having a multiplicity of one of unevennesses, indentations, cavities, holes and craters; then b) applying at least two hotmelt adhesives, each in the form of a melt, to the flat side surface of the oriented strand board, wherein:

b1) first, an initial hotmelt adhesive melt is applied such that the unevennesses, indentations, cavities, holes or craters are filled at least substantially with the initial hotmelt adhesive, so as to form at least one hotmelt adhesive levelling filling, thus effecting homogenization and levelling of the flat side surface of the oriented strand board, and, b2) subsequently, a further hotmelt adhesive melt is applied such that the flat side surface of the oriented strand board is coated and filmed at least partially or sectionally with the further hotmelt adhesive melt, especially, thus resulting in at least one hotmelt adhesive layer top (capping) layer disposed on the flat side surface of the oriented strand board;

c) cooling and consolidating each hotmelt adhesive melt under curing and solidifying after implementation of each of steps b1) and b2) respectively, wherein step b1), on the one hand, and step b2), on the other hand, are carried out in separate steps, and wherein step b1) is carried out followed by cooling and consolidation of the initial hotmelt adhesive and subsequently step b2) is carried out followed by cooling and consolidation of the further hotmelt adhesive.

11. The method according to claim 10, furnishing an oriented strand board (OSB wood composite board) which has been provided with applications properties for the exterior sector.

12. The method according to claim 10, producing weathering-, UV- and/or moisture-resistant and/or decorative panelling, facings, façade elements, façade panels, construction elements and construction boards.

13. The method according to claim 10, producing furniture, furniture elements and/or decorative furniture panels, construction elements, construction boards, weathering-, UV- and/or moisture-resistant packaging and/or transport elements and/or panels, packaging and/or transport devices, packaging and/or transport containers and/or crates.

14. A method for levelling a flat side surface of an oriented strand board (OSB wood composite board), wherein the method comprises the following steps in the stated sequence:

a) providing the oriented strand board, wherein the oriented strand board comprises the flat side surface having a multiplicity of one of unevennesses, indentations, cavities, holes and craters; then b) applying at least two hotmelt adhesives, each in the form of a melt, to the flat side surface of the oriented strand board, wherein:

b1) first, an initial hotmelt adhesive melt is applied such that the unevennesses, indentations, cavities, holes or craters are filled at least substantially with the initial hotmelt adhesive, followed by cooling and consolidation of the initial hotmelt adhesive, so as to form at least one hotmelt adhesive levelling filling, thus effecting homogenization and levelling of the flat side surface of the oriented strand board, and, b2) subsequently, a further hotmelt adhesive melt is applied such that the flat side surface of the oriented strand board is coated and filmed at least partially or sectionally with the further hotmelt adhesive melt, especially followed by cooling and consolidation of the further hotmelt adhesive, thus resulting in at least one hotmelt adhesive layer top (capping) layer disposed on the flat side surface of the oriented strand board;

wherein step b1), on the one hand, and step b2), on the other hand, are carried out in separate steps.

15. A method for levelling a flat side surface of an oriented strand board (OSB wood composite board), wherein the method comprises the following steps in the stated sequence:

a) providing the oriented strand board, wherein the oriented strand board comprises the flat side surface having a multiplicity of one of unevennesses, indentations, cavities, holes and craters; then b) applying at least two hotmelt adhesives, each in the form of a melt, to the flat side surface of the oriented strand board, wherein:

b1) first, an initial hotmelt adhesive melt is applied such that the unevennesses, indentations, cavities, holes or craters are filled at least substantially with the initial hotmelt adhesive, so as to form at least one hotmelt adhesive levelling filling, thus effecting homogenization and levelling of the flat side surface of the oriented strand board, and, b2) subsequently, a further hotmelt adhesive melt is applied such that the flat side surface of the oriented strand board is coated and filmed at least partially or sectionally with the further hotmelt adhesive melt, especially, thus resulting in at least one hotmelt adhesive layer top (capping) layer disposed on the flat side surface of the oriented strand board, wherein the hotmelt adhesives have a softening point or softening range, determined according to DIN EN 1238:2011-07, in the range of from 30° C. to 200° C., and wherein before the application of the hotmelt adhesives to the surface, a preheating of the flat side surface is carried out;

c) cooling and consolidating each hotmelt adhesive melt under curing and solidifying after implementation of each of steps b1) and b2) respectively, wherein step b1), on the one hand, and step b2), on the other hand, are carried out in separate steps, and wherein step b1 is carried out followed by cooling and consolidation of the initial hotmelt adhesive, and subsequently step b2 is carried out followed by cooling and consolidation of the further hotmelt adhesive.

* * * * *